US006848964B1

(12) United States Patent
Sasaki et al.

(10) Patent No.: US 6,848,964 B1
(45) Date of Patent: Feb. 1, 2005

(54) SEALING METHOD AND APPARATUS FOR MANUFACTURING HIGH-PERFORMANCE GAS DISCHARGE PANEL

(75) Inventors: Yoshiki Sasaki, Shijounawate (JP); Kinzou Nonomura, Ikoma (JP); Junichi Hibino, Neyagawa (JP); Hiroyuki Yonehara, Hirakata (JP); Katuyoshi Yamashita, Katano (JP); Nobuyuki Kirihara, Hirakata (JP); Kazuo Ootani, Habikino (JP); Masafumi Ookawa, Neyagawa (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 0 days.

(21) Appl. No.: 09/786,958

(22) PCT Filed: Sep. 14, 1999

(86) PCT No.: PCT/JP99/04961

§ 371 (c)(1),
(2), (4) Date: Jul. 2, 2001

(87) PCT Pub. No.: WO00/16364

PCT Pub. Date: Mar. 23, 2000

(30) Foreign Application Priority Data

| | | |
|---|---|---|
| Sep. 14, 1998 | (JP) | 10-259880 |
| Oct. 16, 1998 | (JP) | 10-294953 |
| Mar. 10, 1999 | (JP) | 11-062765 |
| Mar. 12, 1999 | (JP) | 11-066407 |
| Apr. 28, 1999 | (JP) | 11-122106 |

(51) Int. Cl.[7] ..... H01J 9/32
(52) U.S. Cl. ..... 445/25; 445/43; 445/70
(58) Field of Search ..... 445/25, 43, 70

(56) References Cited

U.S. PATENT DOCUMENTS

| | | | | |
|---|---|---|---|---|
| 5,108,333 A | * | 4/1992 | Heider et al. | 445/26 |
| 5,207,607 A | | 5/1993 | Nagano et al. | |
| 5,693,111 A | | 12/1997 | Kadowaki et al. | 65/43 |
| 5,754,003 A | | 5/1998 | Murai et al. | |
| 6,414,434 B1 | * | 7/2002 | Nakano et al. | 313/582 |
| 6,506,089 B2 | * | 1/2003 | Nakanishi et al. | 445/25 |

FOREIGN PATENT DOCUMENTS

| | | |
|---|---|---|
| EP | 451362 | 10/1991 |
| EP | 945886 | 9/1999 |
| JP | 50-3570 | 5/1973 |
| JP | 60-193229 | 10/1985 |
| JP | 01-235125 | 9/1989 |
| JP | 04-002030 | 1/1992 |
| JP | 4-212240 | 8/1992 |
| JP | 10-208637 | 8/1997 |
| JP | 9-251839 | 9/1997 |
| WO | 9827571 | 6/1998 |

* cited by examiner

*Primary Examiner*—Hung V. Ngo

(57) ABSTRACT

A method is provided to steadily produce a gas discharge panel, such as a PDP, in which a panel and the top of the barrier ribs are in intimate contact in entirety. First a surrounding unit for the gas discharge panel is formed, then a process for sealing the surrounding unit with a sealing material inserted between two panels at the rim is performed while pressure is adjusted so that pressure inside the surrounding unit is lower than pressure outside. With this construction, the panels constituting the surrounding unit are bonded together while they are pressurized from outside. As a result, a panel and the top of the barrier ribs on the other panel are bonded together while they are in intimate contact in entirety. To fully acquire these effects, it is preferable that the adjustment of pressure starts before the sealing material hardens. During, before, or after the sealing step, an energy such as laser beams or ultrasonic waves may be radiated onto the top of the barrier ribs to bond a panel and the top of the barrier ribs in entirety almost without a gap between them.

25 Claims, 29 Drawing Sheets

SEALING METHOD AND APPARATUS FOR MANUFACTURING HIGH-PERFORMANCE GAS DISCHARGE PANEL

TECHNICAL FIELD

This invention relates to a method for producing a gas discharge panel, more specifically to a process for bonding a front panel and a back panel.

BACKGROUND ART

Recently, as the demand for high-quality large-screen TVs such as high definition TVs has increased, displays suitable for such TVs, such as Cathode Ray Tube (CRT), Liquid Crystal Display (LCD), and Plasma Display Panel (PDP), have been developed.

CRTs have been widely used as TV displays and excel in terms of resolution and picture quality. However, the depth and weight increase as the screen size increases. Therefore, CRTs are not suitable for large screen sizes exceeding 40 inch. LCDs consume a small amount of electricity and operate on a low voltage. However, producing a large LCD screen is technically difficult, and the viewing angles of LCDs are limited.

On the other hand, it is possible to make a PDP with a large screen with a short depth, and 50-inch PDP products have already been developed.

PDPs are divided into two types: Direct Current (DC) and Alternating Current (AC). Currently, PDPs are mainly AC-type since they are suitable for large screens.

AC surface-discharge type PDP, a typical AC-type PDP, is typically composed of a front panel and a back panel to each of which electrodes are attached so that the electrodes of both panels face each other. A space between the front panel and the back panel is divided into a plurality of spaces by barrier ribs. The plurality of spaces between these barrier ribs are each filled with discharge gas and any of red, green, and blue all fluorescent substances. When a driving circuit applies a voltage to each electrode to cause a discharge, ultraviolet light is emitted. The ultraviolet light excites fluorescent substances. The excited fluorescent substances emit red, green, and blue lights. The emitted light of these colors forms images on the screen.

Typically, such PDPs are manufactured by the following procedure. The barrier ribs are disposed on a surface of the back panel; fluorescent substance layers are formed in grooves between the barrier ribs; the front panel is laid on top of the barrier ribs to form a surrounding unit (the front panel and the back panel bonded together with inner space in between); the rim of the surrounding unit, that is, the front and back panels, is sealed with a sealing material; gas is exhausted from the inner space to produce a vacuum; and the inner space is filled with a discharge gas.

The sealing material is typically a low-melting glass that softens by heat. A mixture of the low-melting glass and a binder is applied by a dispenser or the like to the rim of either the front panel or the back panel before the surrounding unit is constructed by putting the panels together. In the sealing process, the panels are bonded by heating the panels to a temperature higher than the softening point of the low-melting glass while the rim of the surrounding unit covering the applied sealing material and the outermost area is fixed by clips or the like.

However, the PDPs manufactured with such a method have gaps between the barrier ribs and the front panel. The gaps vary from barrier rib to barrier rib or from point to point on each barrier rib. The reason for this is considered as follows. (1) Variations of the barrier ribs in height are generated in the barrier rib formation process in which the material for the barrier ribs are placed on the back panel. (2) The panels and the barrier ribs are distorted in heating processes such as the processes for baking the barrier ribs, fluorescent substance, electrodes, and dielectric layer, and the sealing glass layer temporary baking process which are performed before the sealing process.

Further, in the sealing process of PDP, the rim of the front panel and the back panel is fixed by fastening tools such as clips so as to prevent displacement of the panels after they were positioned to face each other. However, such fastening of the rim tends to generate a gap between the top of the barrier ribs and the front panel at the center by the action of a lever. In addition, unequal gaps are often formed since the pressures given by the fastening tools are different.

In the PDPs manufactured through the sealing process with such gaps, crosstalks often occur when the PDPs are activated, or noises often occur between the barrier ribs and the panels due to vibration of the panels caused by the u discharge or the like.

Japanese Utility Model Publication No. 1-113948 discloses a technique in which a low-melting glass is applied to the top of the barrier ribs before the front and back panels are positioned to face each other and bonded together. When the front panel is bonded with the whole top of the barrier ribs using this technique, the surrounding unit does not expand even if the inner space is filled with a discharge gas at high pressure. Also, the gaps between the barrier ribs and the front panel are filled with the sealing material. Accordingly, the technique solves the problem of the vibration.

However, in reality, it is difficult to bond the whole top of the barrier ribs with the front panel. A part of the top of the barrier ribs often remains unattached. Accordingly, this technique is not sufficient to solve the problem of the pressure. Especially, when there are variations of the barrier ribs in height on the back panel, many parts remain unattached. When this happens, it is impossible to obtain sufficient resistance to pressure.

There is another conventional method in which a set of the front and back panels is heated for sealing while a weight such as a stone is placed at the center thereof. However, according to this method, more energy is required for the heating since the weight on the panels is also heated. The heating temperatures for surrounding units tends to be unequal. It is difficult to use this technique for the production of large-screen PDPs.

There is another requirement for the production of the panels. Typically, a vacuum pump or a discharge gas-cylinder is connected to an exhaust pipe attached to the surrounding unit. The exhaust pipe is chipped off later by a burner or a heater. A reliable method of chipping off the exhaust pipe is desired.

DISCLOSURE OF INVENTION

It is an object of the present invention to provide a method of steadily producing a gas discharge panel, such as a PDP, in which a panel and the top of the barrier ribs are in intimate contact in entirety.

To achieve the above object, first a surrounding unit for the gas discharge panel is formed, then a process for sealing the surrounding unit with a sealing material inserted between two panels at the rim is performed while pressure is adjusted so that pressure inside the surrounding unit is lower than pressure outside the surrounding unit.

With the above-stated construction, the panels constituting the surrounding unit are bonded together while they are pressurized from outside. As a result, a panel and the top of the barrier ribs on the other panel are bonded together while they are in intimate contact in entirety.

To acquire the above effects, it is preferable that the adjustment of pressure starts before the sealing material hardens.

The adjustment of pressure can be achieved with the following methods:

(1) A connection path which connects inside of the surrounding unit to outside of the surrounding unit is formed, and gas is exhausted from inside of the surrounding unit to outside of the surrounding unit via the connection path.

(2) A container whose inside is under a pressure lower than the pressure inside the surrounding unit is used to reduce the pressure inside the surrounding unit.

(3) The gas flow between inside and outside of the surrounding unit is interrupted; then the pressure inside the surrounding unit after the gas-flow interruption is adjusted to be lower than before the gas-flow interruption (more specifically, temperature in the surrounding unit is decreased, or the gas adsorption action of a gas adsorption member is used).

(4) The pressure outside the surrounding unit after the sealing of the rim of the surrounding unit is adjusted to be higher than before the sealing of the rim of the surrounding unit.

An adhesive may be applied to top of the barrier ribs on one panel before the surrounding unit is formed. The other panel and the top of the barrier ribs are bonded together by the adhesive while the rim of the surrounding unit is sealed by a sealing material. With such a construction, a panel and the top of the barrier ribs on the other panel are bonded together in entirety almost without a gap between them.

During or adjacent steps of the sealing step, an energy such as laser beams or ultrasonic waves may be radiated onto the top of the barrier ribs to bond a panel and the top of the barrier ribs. With this method, it is also possible to bond a panel and the top of the barrier ribs on the other panel together in entirety almost without a gap between them.

It is preferable that the sealing step is performed while the panels are pressurized by fastening tools pinching the panels so that the sealing process is more ensured. In this case, it is further preferable that an anti-deformation member is disposed at a position where the panels are pressurized by the fastening tools so as to prevent the panels from deforming by pressure by the fastening tools.

It is also preferable that the sealing step is performed while the surrounding unit is provided with anti-displacement means for preventing the relative displacement of the panels. It is further preferable that an anti-sealing-material-inflow member is disposed at the rim of a panel so as to prevent the sealing material from flowing into an inner area of the surrounding unit.

To chip off the exhaust pipe with reliability and C) without difficulty: a heating element holding means may be attached to the exhaust pipe; the heating element holding means holds a heating element at a location a predetermined distance from the exhaust pipe; and the heating element is activated in this condition.

BEST MODE FOR CARRYING OUT THE INVENTION

<General Construction and Production Method of PDP>

Figure 1:
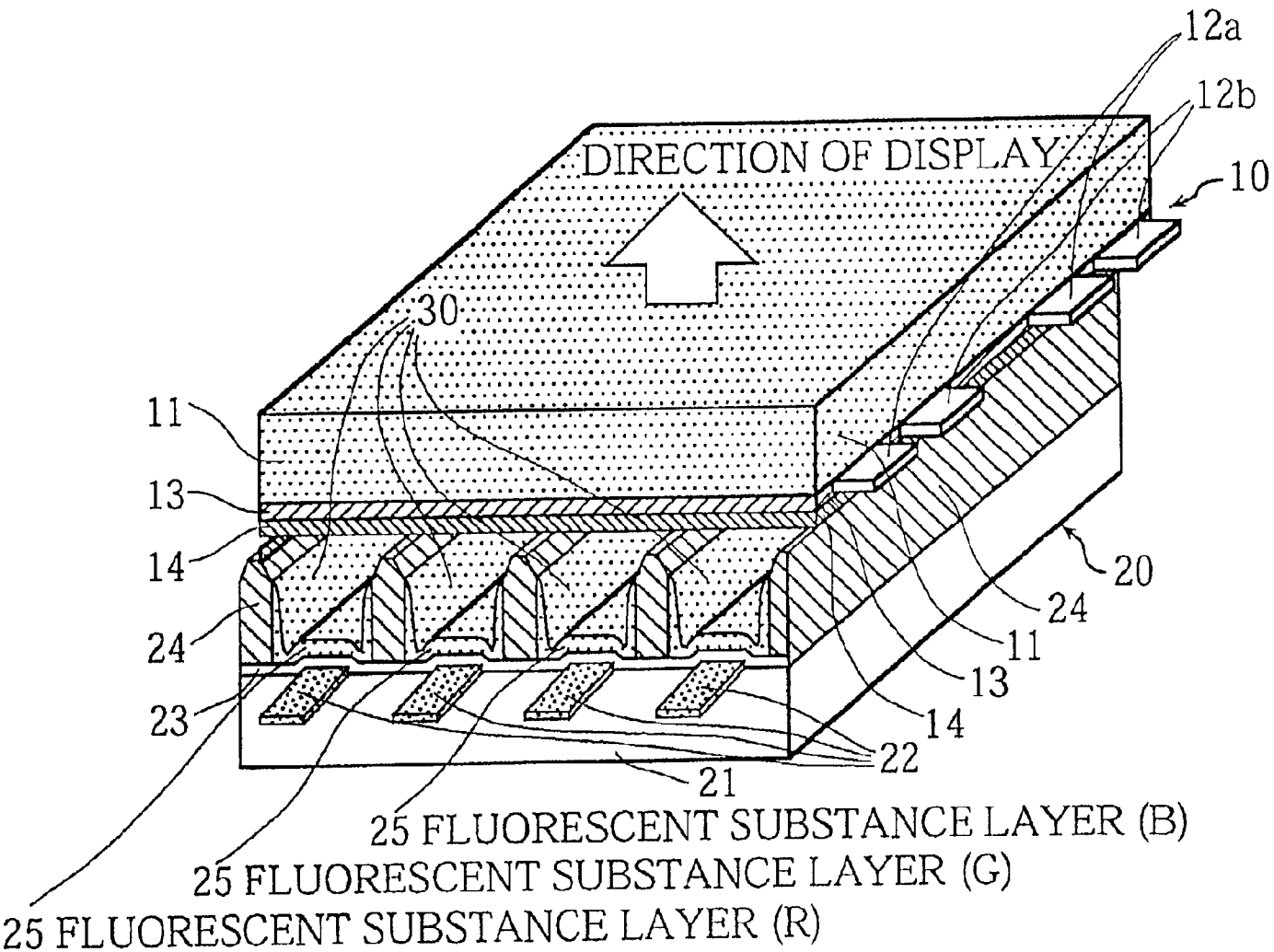
FIG. 1 is a perspective view of the AC surface-discharge type PDP in Embodiment 1.
Figure 2:
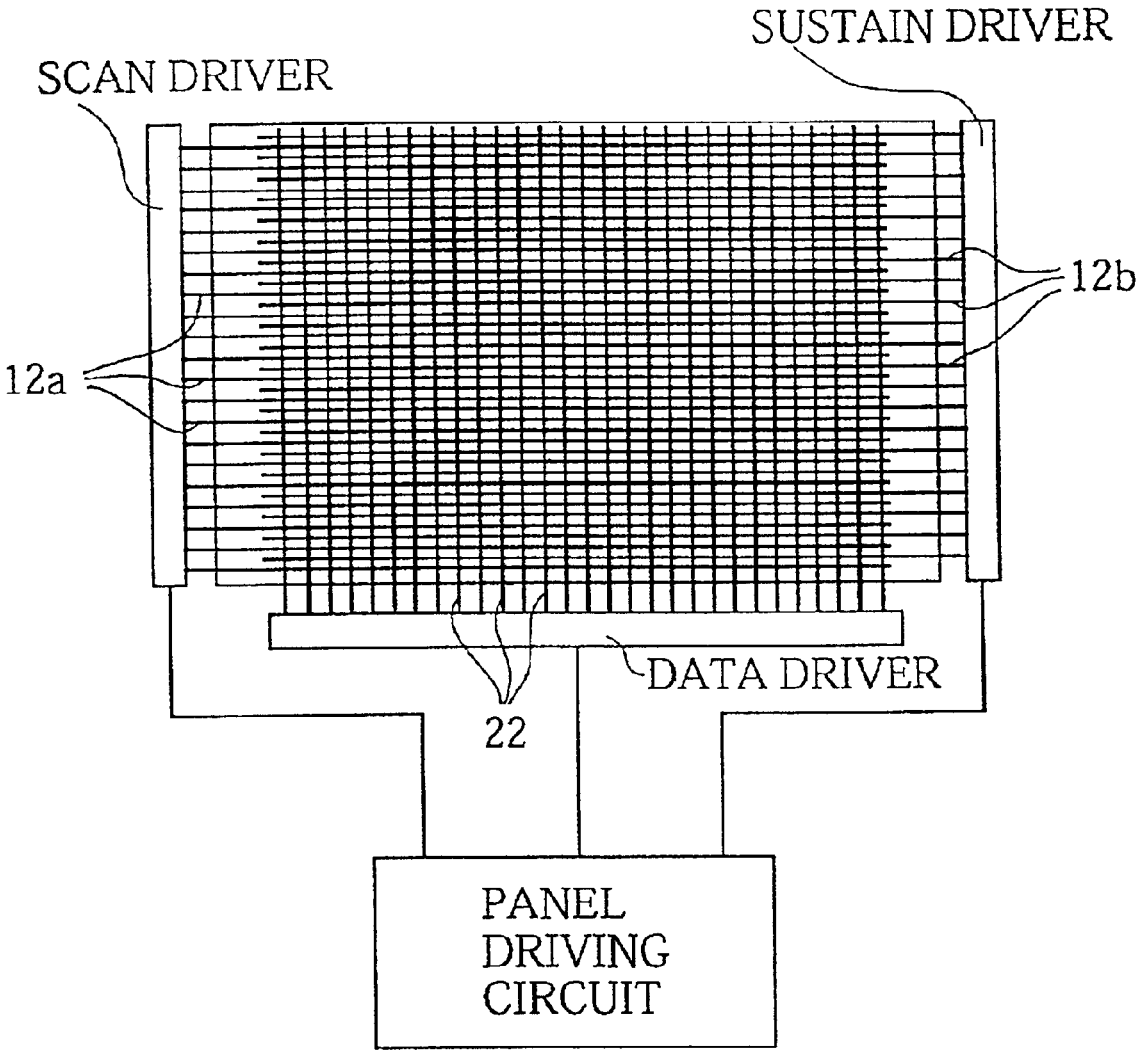
FIG. 2 shows a construction of a display apparatus which is composed of a PDP and a circuit block attached to the PDP.

FIG. 1 is a perspective view of the AC surface-discharge type PDP in the present embodiment. FIG. 2 shows a construction of a display apparatus which is composed of a PDP and a circuit block attached to the PDP.

The PDP includes: a front panel 10 which is made up of a front glass substrate 11 with discharge electrodes 12 (divided into scanning electrodes 12*a* and sustaining electrodes 12*b*), a dielectric layer 13, and a protecting layer 14 formed thereon; and a back panel 20 which is made up of a back glass substrate 21 with address electrodes 22 and a dielectric layer 23 formed thereon. The front panel 10 and the back panel 20 are arranged so that the discharge electrodes 12 and the address electrodes 22 face each other with space in between.

The center area of the PDP is used for displaying images. At the center area, the space between the front panel 10 and the back panel 20 is divided into a plurality of discharge spaces 30 by barrier ribs 24 formed in stripes. Each discharge space is filled with a discharge gas. Fluorescent substance layers 25 are formed on the back panel 20 so that each discharge space 30 has a fluorescent substance layer of one color out of red, green, and blue. The fluorescent substance layers are repeatedly arranged in the order of the colors.

In the panel, the discharge electrodes 12 and address electrodes 22 are respectively formed in stripes, the discharge electrodes 12 being perpendicular to the barrier ribs 24, and the address electrodes 22 being parallel to the barrier ribs 24.

A cell having one color out of red, green, and blue is formed at each intersection of a discharge electrode 12 and an address electrode 22.

The dielectric layer 13, being a layer composed of a dielectric material, covers the entire surface of one side of the front glass substrate 11 including the discharge electrodes 12. The dielectric layer is typically made of a low-softening-point glass containing lead as the main component, though it may be made of a low-softening-point glass containing bismuth as the main component or a stack of a low-softening-point glass containing lead as the main component and a low-softening-point glass containing bismuth as the main component.

The protecting layer 14 made of magnesium oxide (MgO) is a thin layer covering the entire surface of the dielectric layer 13. The dielectric layer 23 is mixed with $TiO_2$ grains so that the layer also functions as a visible-light reflecting layer. The barrier ribs 24, which are made of glass material, are formed to project over the surface of the dielectric layer 23 of the back panel 20.

The front panel 10 and the back panel 20 are bonded by a sealing material at the rim of the PDP.

The top of the barrier ribs 24 and the front panel 10 contact each other or are bonded together almost in entirety.

Now, a PDP production method is described.

Producing the Front Panel

The discharge electrodes 12 are formed on the front glass substrate 11. The dielectric layer 13 is then formed to cover the discharge electrodes 12. The front panel 10 is complete after the protecting layer 14 made of magnesium oxide (MgO) is formed on the dielectric layer 13 with the vacuum vapor deposition, electron-beam evaporation, or chemical vapor deposition.

The discharge electrodes 12 are formed by first applying a paste for silver electrode to the front glass substrate 11 with the screen printing method and then baking the applied paste. Alternatively, the discharge electrodes 12 may be formed first by forming transparent electrodes made of ITO (indium tin oxide) or $SnO_2$, then forming silver electrodes as described above or forming Cr—Cu—Cr electrodes with the photolithography method, on the transparent electrodes.

The dielectric layer 13 is formed by applying a paste including a glass material containing lead as the main component (the composition is, for example, 70% by weight of lead oxide (PbO), 15% by weight of boron oxide ($B_2O_3$), and 15% by weight of silicon oxide ($SiO_2$)) with the screen printing method, then baking the applied paste.

Producing the Back Panel

The address electrodes 22 are formed on the back glass substrate 21 in the same way as the discharge electrodes 12 by the screen printing method.

The dielectric layer 23 is then formed first by applying a glass material mixed with $Tio_2$ grains and baking the applied material.

The barrier ribs 24 are then formed by recoating a paste for barrier ribs with the screen printing method and baking the coated paste. Alternatively, the barrier ribs 24 may be formed by applying a glass paste for barrier ribs to the entire surface of the back glass substrate 21 and trimming the paste with the sand blast method to leave the barrier ribs.

The fluorescent substance layers 25 are formed between the barrier ribs 24. Typically, the fluorescent substance layers 25 are formed by applying fluorescent substance pastes containing fluorescent substance grains for the three colors with the screen printing method and baking the applied pastes. Alternatively, the fluorescent substance layers 25 may be formed by moving a nozzle continuously ejecting a fluorescent substance ink along the barrier ribs to apply the ink to the grooves between the barrier ribs then baking the applied ink to remove solvents or binders from the ink. The fluorescent substance ink of each color is a mixture of fluorescent substance grains of one color, a binder, a solvent, a dispersant, etc. adjusted to have a proper viscosity.

The following are specific examples of the fluorescent substances used in the present embodiment:

blue fluorescent substance $BaMgAl_{10}O_{17}$: $Eu^{2+}$ green fluorescent substance $BaAl_{12}O_{19}$: Mn, or $Zn_2SiO_4$: Mn red fluorescent substance $(Y_xGd_{1-x})BO_3$: $Eu^{3+}$, or $YBO_3$: $Eu^{3+}$ In the present embodiment, the height of the barrier ribs is set to 0.1–0.15 mm, and the pitch of the barrier ribs to 0.15–0.36 mm, conforming to 40-inch VGAs and high definition TVs.

Sealing, Exhausting Gas, and Filling with Discharge Gas

The front panel and the back panel formed as described above are then bonded together.

In this sealing process, the front panel 10 and the back panel 20 are put together with a sealing material in between at their rims to form a surrounding unit. The panels are bonded together by the sealing material. Should the necessity arises, an adhesive is applied to the top of the barrier ribs 24 on the back panel 20 beforehand.

A material that softens by a given energy such as heat, is used as the sealing material. Typically, a low-melting glass is used as the sealing material. The panels with the low-melting glass is heated to a temperature higher than the softening point of the glass and is cooled so that the panels are bonded together by the cooled glass.

The panels are subjected to the sealing process while there is a difference between the pressures outside and inside the surrounding unit so that the panels 10 and 20 are given equal pressures from outside. This enables the panels to be bonded together while the top of the barrier ribs 24 and the front panel 10 are in contact or close to each other in entirety.

After the sealing process, gas is exhausted from the inner space to produce a high vacuum (e.g., $8\times10^{-7}$ Torr) and exhaust impurities held by adsorption on the inside surface of the surrounding unit (Vacuum Exhaust Process).

The inner space of the surrounding unit is then filled with a discharge gas (e.g., He—Ne or Ne—Xe inact gas) with a certain pressure (Discharge Gas Filling Process). The PDP is completed with this process.

In the present embodiment, Xe constitutes 5% in volume of the discharge gas, and the charging pressure for filling the discharge gas is in a range of 500–800 Torr.

The PDP is activated to display images by the circuit block which is attached to the PDP as shown in FIG. 2.

Embodiments 1 to 10 of the present invention are described as follows in which the sealing, exhaust, and discharge gas filling processes are described in detail.

Embodiment 1

In the present embodiment, the sealing process is performed while gas is exhausted from the inner space of the surrounding unit with a vacuum pump.

Figure 3:
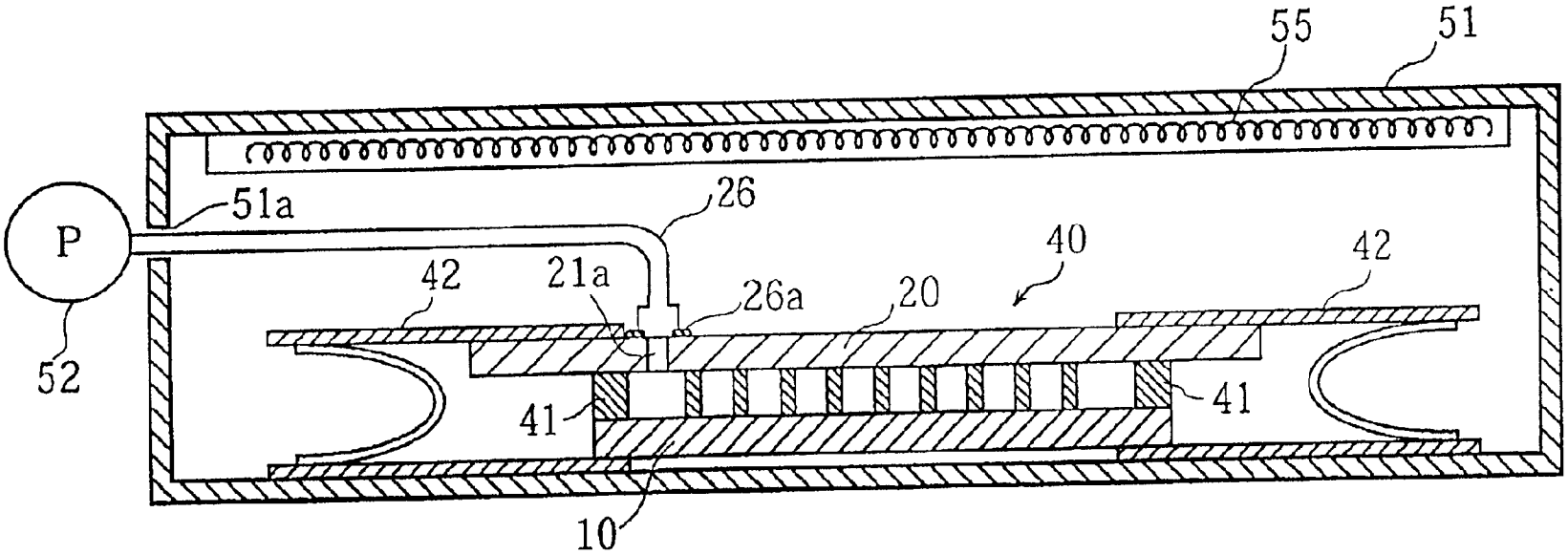
FIG. 3 is a sectional view of the sealing apparatus used in the sealing process of Embodiment 1.
Figure 4:
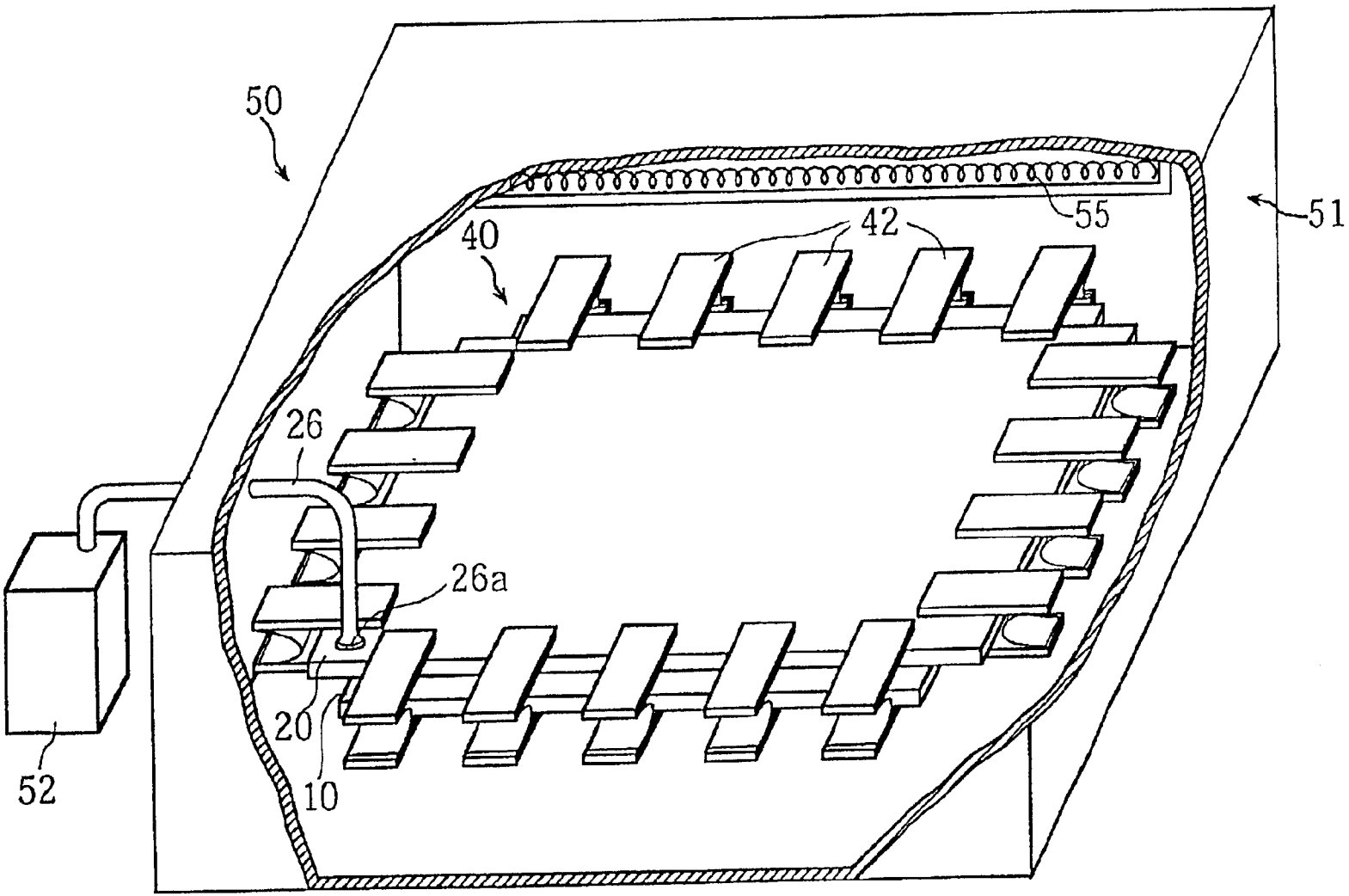
FIG. 4 is a perspective view of the sealing apparatus shown in FIG. 3.

FIG. 3 is a sectional view of the sealing apparatus 50 in the present embodiment. FIG. 4 is a perspective view of the sealing apparatus 50 shown in FIG. 3.

The sealing apparatus 50 is composed of: a furnace 51 for housing and heating the surrounding unit 40 which is the front panel 10 and the back panel 20 put together; and a vacuum pump 52 disposed at outside the furnace 51.

The furnace 51 is heated by a heater 55. It is possible to set the inner temperature of the furnace 51 to a desired degree with control.

The sealing process is performed using the sealing apparatus 50 as follows.

As shown in FIGS. 3 and 4, an air vent 21*a* is previously formed in the back panel 20 at the rim, outside the display area.

A paste mixed with the sealing material is applied to the rim of either of or both the front panel 10 and the back panel 20 on the surfaces facing each other. The applied paste is baked to form a sealing layer 41. In this example, a low-melting glass which has a softening point lower than the barrier ribs 24 and the dielectric layer 23 is used as the sealing material.

For example, the low-melting glass paste includes 80% of a low-melting glass frit (softening point is 370° C.), 5% of an ethyl cellulose binder, and 15% of isoamyl acetate. The sealing layer 41 can be formed by applying the paste using a dispenser.

The front panel 10 and the back panel 20 are positioned properly to face each other and are put together to form the surrounding unit 40. The rim of the surrounding unit 40 is fastened by clips 42 so that the panels are not displaced.

The surrounding unit 40 is set inside the furnace 51. A pipe 26 is attached to the air vent 21*a* of the surrounding unit 40 and the vacuum pump 52 to connect them. It is preferable that the pipe 26 is fixed to the back panel 20 by fastening tools such as clips (not illustrated).

In the present embodiment, the front panel 10 is positioned below the back panel 20 to facilitate the attachment of the pipe 26. However, the positions of the panels can be reversed. Also, the surrounding unit may be set vertically in the furnace so long as the panels 10 and 20 are fixed as firmly as not to be displaced.

The pipe 26 is made of a glass being resistant to the sealing temperature. The pipe 26 extends upwards from the air vent 21*a* of the surrounding unit 40, bends at some midpoint, and extends and protrudes outside from the furnace 51 through a via hole 51*a* which is formed in the wall of the furnace 51. The pipe 26 bulges at the edge (referred to as connection edge) connecting to the air vent 21*a*, and the diameter of the connection edge is larger than that of the air vent 21*a*.

An adhesive 26*a* is inserted between the connection edge of the pipe 26 and the back panel 20 beforehand so that they are airtightly sealed. In the present embodiment, the same material is used for both the adhesive 26*a* and the sealing layer 41.

The end of the pipe 26 is connected to the vacuum pump 52.

The inside of the furnace 51 is heated to the sealing temperature (e.g., 450° C.) which is slightly higher than the softening point of the sealing material. The temperature of the inside of the furnace 51 is maintained at the sealing temperature for 10 to 30 minutes. The inside of the furnace 51 is then cooled until the temperature is below the softening point of the sealing material. The panels 10 and 20 are bonded together by this process. During the sealing process, gas is exhausted from the surrounding unit 40 by the vacuum pump 52.

It is preferable that the above exhaust of gas is started after the inside of the furnace 51 has reached the softening point of the sealing material. This is because the hermeticity at the rim between the panels 10 and 20 is not high until the inside of the furnace 51 reaches the softening point of the sealing material, and that once it reaches the softening point, the adhesive 26*a* softens to airtightly seal the pipe 26 and the air vent 21*a*, as well as the panels 10 and 20 at the rim. Accordingly, when gas is exhausted from the surrounding unit 40 after these parts are airtightly sealed, the pressure inside the surrounding unit 40 is reduced and a high vacuum (several Torr) is produced.

The panels 10 and 20 are equally pressurized from outside after gas is exhausted from the inner space of the surrounding unit 40. The exhaust of gas by the vacuum pump 52 is adjusted so that the pressure inside the surrounding unit 40 is reduced at a speed of about 5 Torr per minute.

When the panels 10 and 20 are equally pressurized from outside, the top of the barrier ribs 24 on the back panel 20 and the front panel 10 are bonded together while they are in intimate contact in entirety, as shown in FIG. 3. When the inside of the furnace is cooled in this condition, the sealing material is also cooled to be below its softening point, resulting in the sealing of the surrounding unit 40. Accordingly, in the surrounding unit 40 after the sealing process, the top of the barrier ribs 24 and the front panel 10 are kept in absolute contact with one another in entirety.

The pipe 26 and the back panel 20 are also airtightly sealed by the hardened adhesive 26*a*.

The clips 42 are removed after the sealing of the surrounding unit 40 is complete and the next step, the vacuum exhaust process is performed.

In the vacuum exhaust process, the surrounding unit 40 is placed in a furnace for vacuum exhaust, a vacuum pump is connected to the pipe 26, the inside of the furnace is kept at an exhaust temperature (e.g., 350° C.) which is slightly lower than the softening point of the sealing material, for a certain period (e.g., one hour).

In the next step, the discharge gas filling process, the discharge gas cylinder is connected to the pipe 26, and the discharge gas is supplied to the inner space of the surrounding unit 40 until the inner space is under the charging pressure (e.g., 400 Torr). The air vent 21*a* is sealed when the base of the pipe 26 is melted by a burner or a heater to be chipped off (see Embodiment 14).

The above procedure may be replaced by another in which the surrounding unit 40 is subjected to the sealing process, vacuum exhaust process, and discharge gas filling process continuously in one heating apparatus. For example, in the sealing apparatus 50, a cylinder for supplying the discharge gas is prepared so that it can be connected to the pipe 26. Then, after the sealing process, the surrounding unit 40 is kept to be set in the furnace 51. The furnace 51 is cooled to the exhaust temperature, then gas is exhausted from the surrounding unit by the vacuum pump 52. Furthermore, the cylinder can be connected to the pipe 26 for supplying the discharge gas.

The above procedure may further be replaced by another in which a continuous heating apparatus is used to perform the sealing process, vacuum exhaust process, and discharge gas filling process continuously. For example, the vacuum pump and the discharge gas cylinder, as well as the surrounding unit 40, are loaded on a cart that can move in a continuous furnace. It is possible that gas is exhausted from the surrounding unit by the vacuum pump and the surrounding unit is filled with the discharge gas by the discharge gas cylinder while the surrounding unit is heated in the continuous furnace.

Effects of the Present Method

In conventional techniques in which the rim of the surrounding unit 40 is fastened by clips without the difference between the pressures outside and inside the surrounding unit 40, the center region of the surrounding unit is not given a pressure. As a result, the front panel 10 and the top of the barrier ribs on the back panel 20 are bonded while they-are partially separated from each other. On the contrary, in the present embodiment, the sealing layer 41 hardens while the panels 10 and 20 are equally pressurized from outside. This enables the panels to be bonded together with almost no space between the front panel 10 and the top of the barrier ribs.

Accordingly, the production method of the present embodiment facilitates the production of PDPs with excellent display quality which hardly generate a vibration when they are activated.

To gain the above effects, the vacuum pump 52 should be activated to cause the difference between the pressures outside and inside the surrounding unit 40 before the once-softened sealing layer 40 start to harden. However, there is no need of operating the vacuum pump 52 from start to finish of the sealing process. For example, it is possible to gain the effect of the pressure difference by activating the vacuum pump 52 after the sealing layer 41 has softened.

Furthermore, the panels 10 and 20 pressurize each other due to the difference between the inside pressure and outside pressure when the panels are bonded while the surrounding unit 40 is sealed with the difference in pressure. As a result, the pressure applied by the clips 42 required to prevent the displacement of the panels may be lower than the conventional methods.

It should be noted here that the clips 42 may not necessarily be used to prevent the displacement of the panels 10 and 20. However, the use of the clips ensures the prevention of the displacement. Furthermore, since the clips 42 also pressurize the sealing layer 41 inserted between the panels at their rim. Due to this pressure, the sealing material spreads equally over the rim when it softens. This airtightly seals the rim.

Different materials may be used for the adhesive 26*a* and the sealing layer 41. However, when the same low-melting glass is used, as in the present embodiment, the sealing layer 41 and the adhesive 26*a* soften and harden with the same timing. That means, the surrounding unit 40 is sealed at the same time the pipe 26 and the air vent 21*a* of the back panel 20 are airtightly sealed.

Variations of the Present Embodiment

In the present embodiment, a low-melting glass is used as the adhesive 26*a*, and pressure is reduced inside the surrounding unit 40 while the adhesive 26*a* is softening. In such a case, the adhesive 26*a* may flow into the air vent 21*a*, so that the seal between the pipe 26 and the air vent 21*a* of the back panel 20 is broken.

To prevent the above problem, a crystallized glass that is crystallized at a temperature lower than the sealing layer 41 may be used. Such a crystallized glass is typically PbO—ZnO—$B_2O_3$ frit glass.

The crystallized glass does not soften even if it is heated again to the initial crystallization temperature once it is heated to fluidize and then is crystallized and solidified. Accordingly, the above problem concerning the seal can be solved by using the crystallized glass as the adhesive 26*a* and slowly heating the surrounding unit 40. With such an arrangement, the crystallized glass has been solidified before the sealing layer 41 starts to soften.

The same effects can be obtained by using, as the adhesive 26*a*, a glass that has a softening point slightly higher than the sealing layer 41.

The above problem may be solved by previously connecting the pipe 26 to the air vent 21*a* of the back panel 20 using as the adhesive 26*a* a material that does not soften at the temperature of bonding the panels (e.g., a glass having a softening point considerably higher than the sealing layer 41, or a ceramic adhesive).

Embodiment 2

Figure 5A:
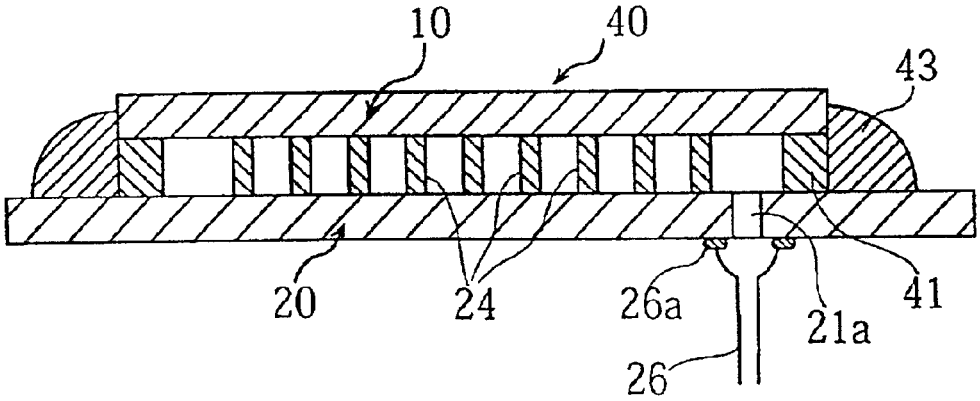
FIGS. 5A and 5B show the sealing process of Embodiment 2.
Figure 5B:
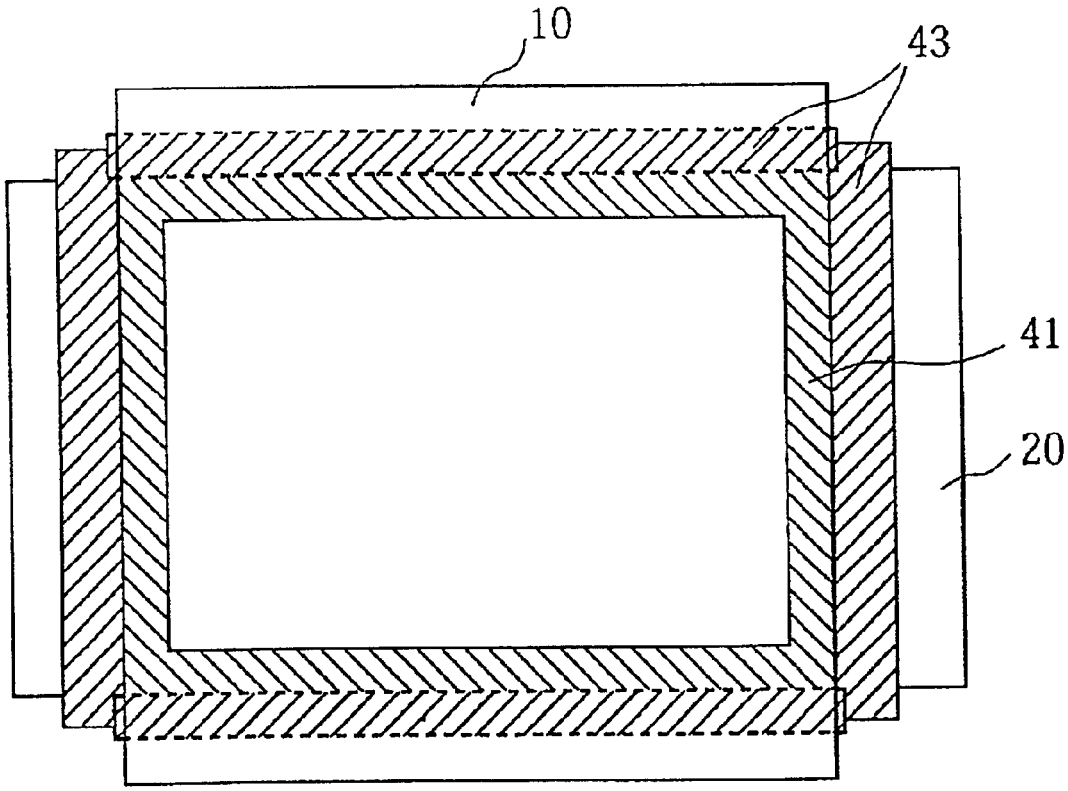

The present embodiment differs from Embodiment 1 in that after the surrounding unit 40 is formed by positioning the panels 10 and 20 to face each other, in the sealing process, an outer sealing layer 43 is further formed outside the sealing layer 41 formed between the panels 10 and 20 at the rim, as shown in FIGS. 5A and 5B.

With the above arrangement, if the seal by the sealing layer 41 has a defect, the defect will be covered by the outer sealing layer 43, so that the sealing process is more ensured. In addition, the outer sealing layer 43 reduces the gap between the top of the barrier ribs and the front panel 10.

Formation of the outer sealing layer 43 provides other effects. For example, the outer sealing layer 43 before softening fixes the panels 10 and 20 and prevents them from being dislocated. Also, a certain degree of hermeticity of the inner space is kept even before the sealing layer 41 or the outer sealing layer 43 softens. As a result, a pressure can be applied to the panels 10 and 20 by driving the vacuum pump 52 to exhaust gas from the inner space.

To obtain the above effects, it is preferable that the same material is used for the sealing layer 41 and the outer sealing layer 43. For example, the paste including a sealing material (low-melting glass) used as the material of the sealing layer 41 can be applied to the outside of the sealing layer 41 of the surrounding unit 40 to form the outer sealing layer 43.

Also, the sealing layer 41 may be formed by applying a ceramic adhesive.

Embodiment 3

Figure 6A:
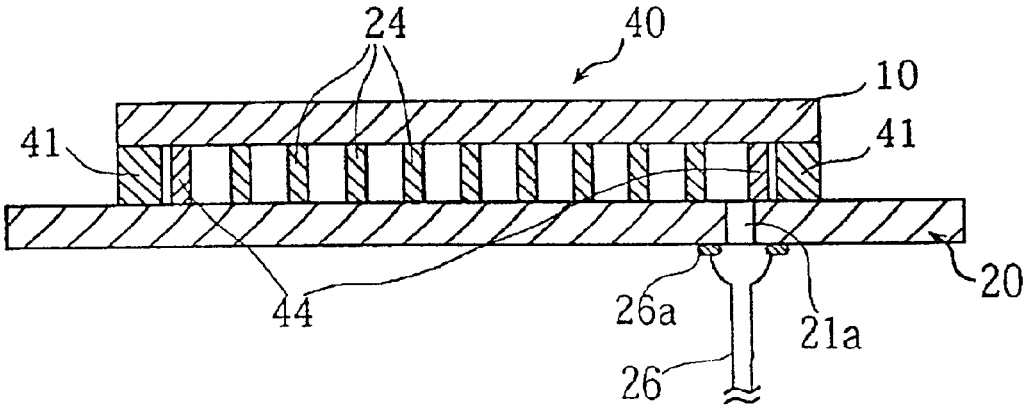
FIGS. 6A and 6B show the sealing process of Embodiment 3.

The present embodiment differs from Embodiment 1 in that an anti-sealing-material-inflow rib 44 is formed inside the area where the sealing layer 41 is to be formed at the rim on either of or both the front panel 10 and the back panel 20, as shown in FIG. 6A.

By forming the anti-sealing-material-inflow rib 44 beforehand, it is possible to prevent the sealing layer 41 from flowing into the display area when the sealing layer 41 has melted during the sealing process and the pressure inside the surrounding unit 40 has become lower than the pressure outside.

It is preferable that the anti-sealing-material-inflow rib 44 has about the same height as the barrier ribs 24. This is because: when the rib 44 is higher than the barrier ribs 24, a gap is generated between the front panel 10 and the top of the barrier ribs 24; and when the rib 44 is much lower than the barrier ribs 24, the effect of preventing the inflow of the sealing layer 41 cannot be expected.

Figure 6B:
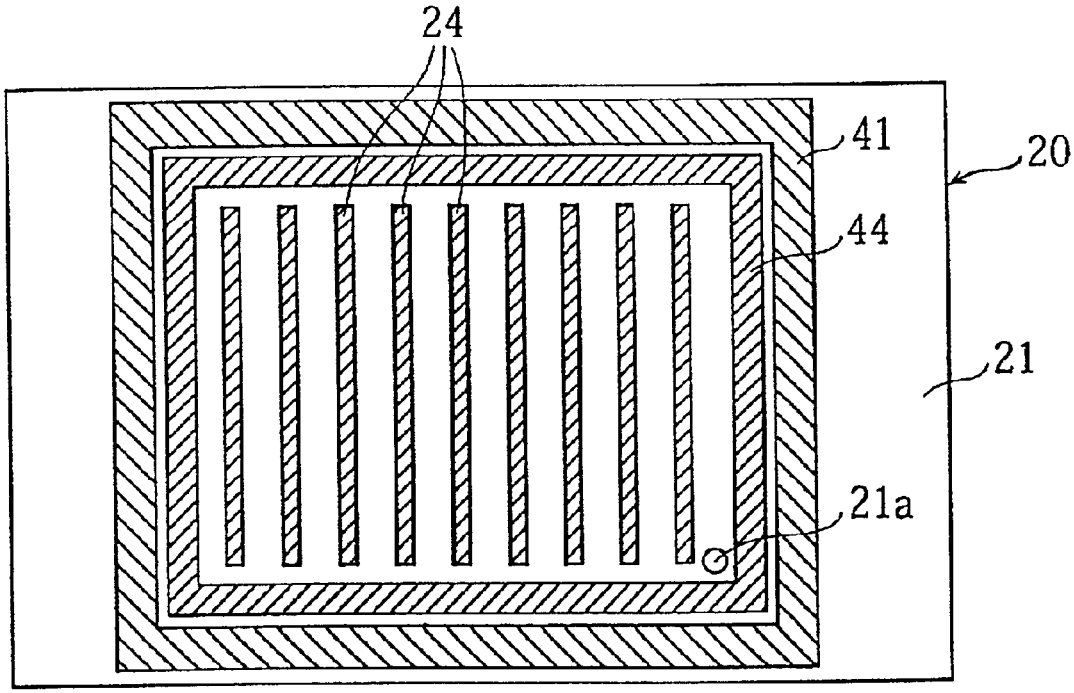

An easy way to form the anti-sealing-material-inflow rib 44 is to form it using the same material as, and simultaneously with, the barrier ribs 24 on the back glass substrate 21 of the back panel 20, as shown in FIG. 6B.

Embodiment 4

The present embodiment differs from Embodiment 1 in that during the sealing process, a pressure is applied from outside to the surrounding unit 40 to generate the difference between the pressures outside and inside the surrounding unit 40 while in Embodiment 1, the gas is exhausted from the inner space of the surrounding unit to reduce the inner pressure.

Figure 7:
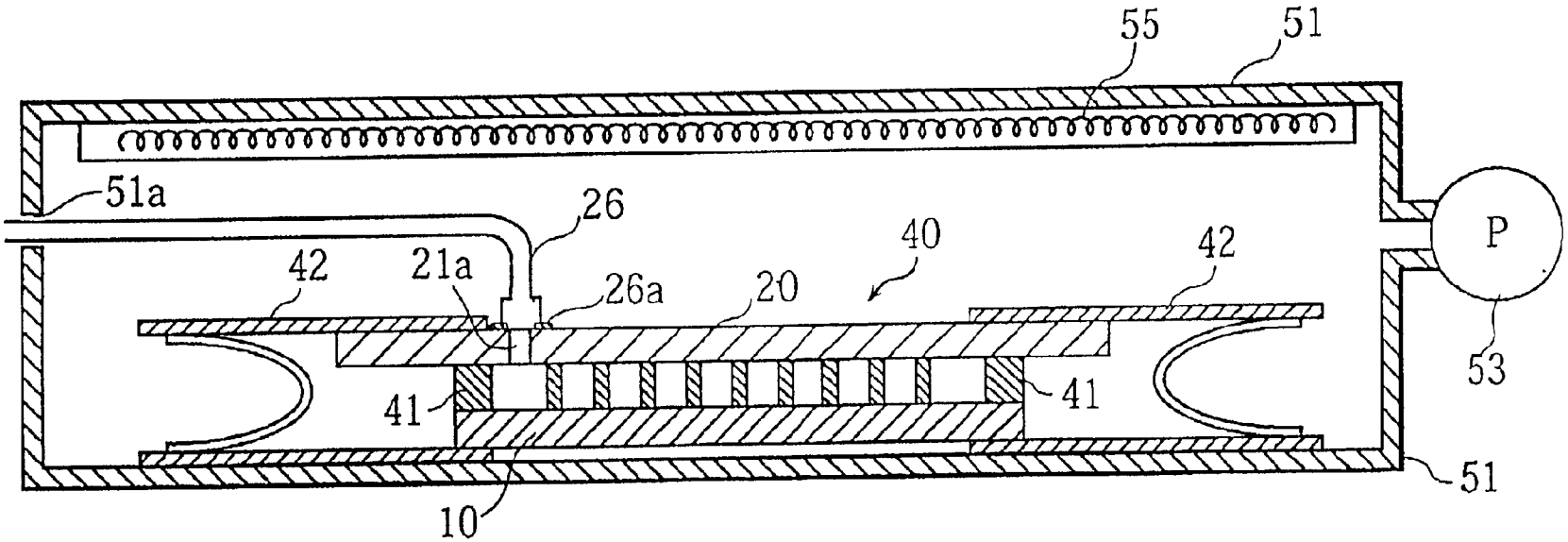
FIG. 7 shows the sealing process of Embodiment 4.

To achieve the above, the vacuum pump 52 is excluded from the sealing apparatus 50 of the present embodiment, but a pressurizing pump 53 is attached to the furnace 51 which can be, in the present embodiment, hermetically sealed, as shown in FIG. 7.

In the sealing process of the present embodiment, the surrounding unit 40 is heated and sealed in the furnace 51 while the inside of the furnace 51 is pressurized by the pressurizing pump 53, with the end of the pipe 26 is open to the air outside the furnace 51.

The method of sealing the surrounding unit 40 as described above provides the same effects as Embodiment 1 since the surrounding unit 40 is sealed while it receives a pressure from outside. More specifically, the sealing process is performed while the inner space of the surrounding unit 40 is kept to be substantially at atmospheric pressure and the outside of the surrounding unit 40 is at a high pressure.

Embodiment 5

Figure 8:
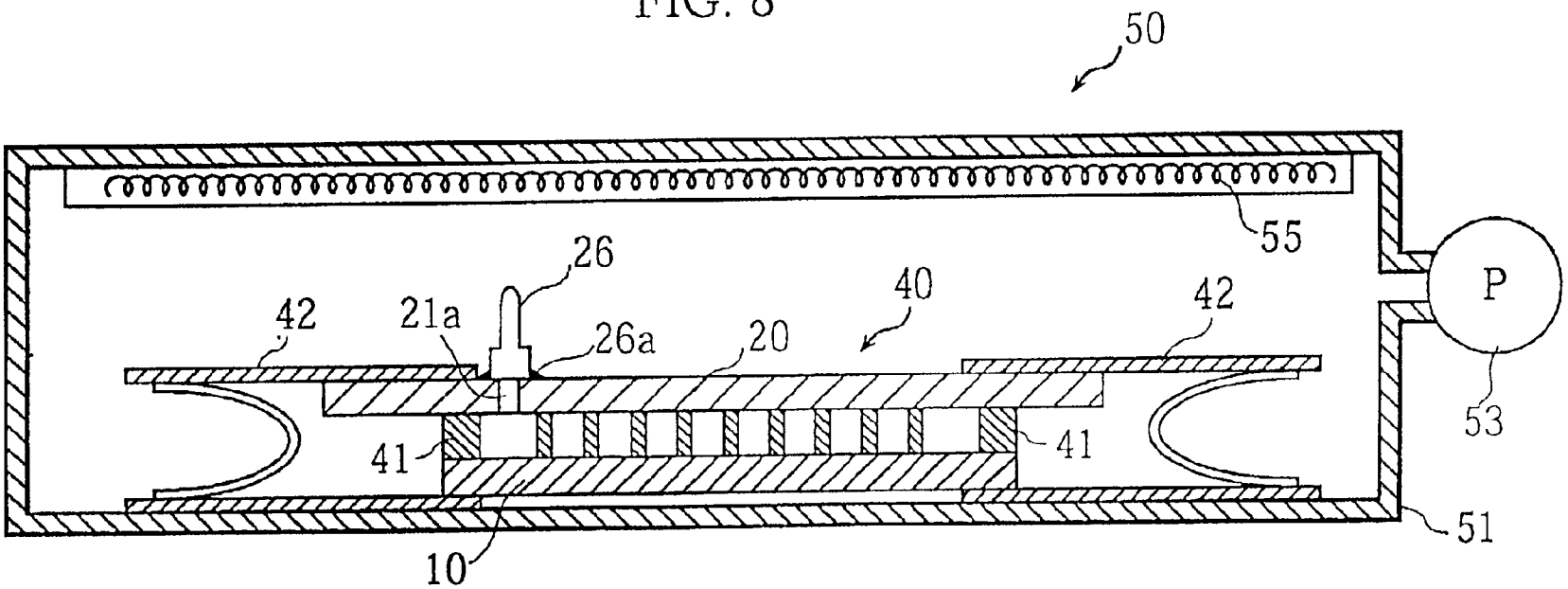
FIG. 8 shows the sealing process of Embodiment 5.

In the present embodiment, the surrounding unit 40 is sealed using the same sealing apparatus 50 as Embodiment 4. However, the pipe 26 of the present embodiment is linear and does not go out the furnace 51, with its end sealed off, as shown in FIG. 8.

Figure 9A:
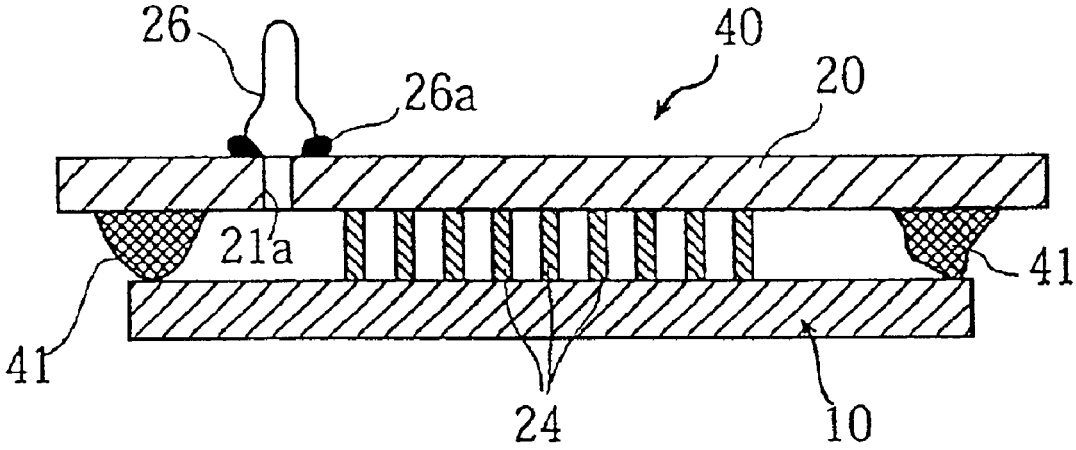
FIGS. 9A and 9B show the sealing process of Embodiment 6.
Figure 9B:
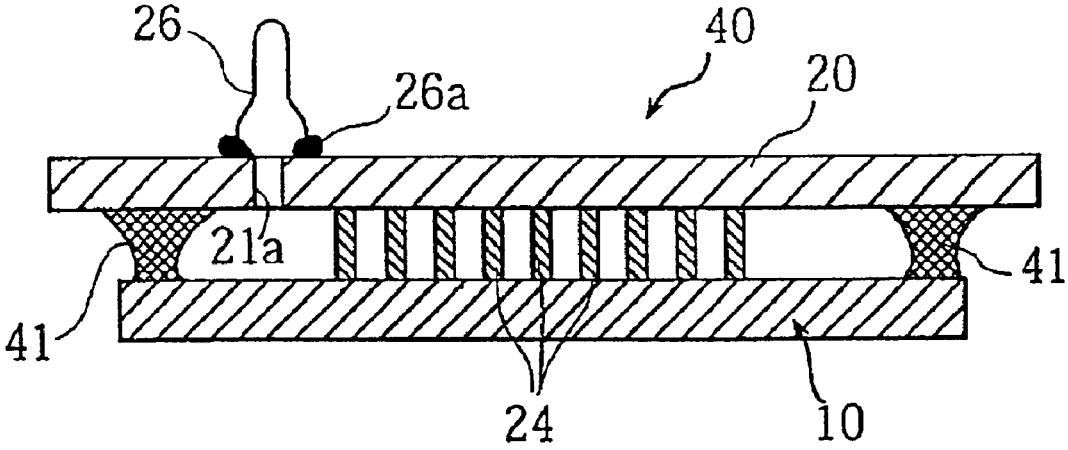

FIG. 9A shows the state of the surrounding unit 40 before the sealing layer 41 softens during the sealing process in which the surrounding unit 40 is sealed by the sealing layer 41, and FIG. 9B the state after the sealing layer 41 has softened. The sealing process of the present embodiment will be explained with reference to FIGS. 9A and 9B.

First, the sealing layer 41 is softened by heating the surrounding unit 40 in the furnace 51 while the inside of the furnace 51 is kept at atmospheric pressure, with the pressurizing pump 53 not activated.

As shown in FIG. 9A, gas can flow into or flow out from the surrounding unit 40 before the sealing layer 41 softens. Accordingly, the pressure in the inner space is almost the same as the atmospheric pressure when the sealing layer 41 softens.

After the sealing layer 41 and the adhesive 26*a* soften, the pressurizing pump 53 is activated to pressurize the inside of the furnace 51.

As shown in FIG. 9B, after the sealing layer 41 and the adhesive 26*a* have softened, the gas flow between the inside and outside of the surrounding unit 40 is blocked. When the inside of the furnace 51 is pressurized under these conditions, the inner space of the surrounding unit 40 remains almost the same as the atmospheric pressure, while the outside of the surrounding unit 40 is at a higher pressure than the inside.

When the inside of the furnace 51 is cooled at a high pressure as above, the sealing layer 41 hardens and the surrounding unit is sealed while it is pressurized from outside.

As understood from the above description, the method of the present embodiment provides the same effects as Embodiment 1.

The sealing process as above is followed by the vacuum exhaust process in which the end of the pipe 26 is cut and opened, the vacuum pump is connected to the end, and gas is exhausted from the inner space by the vacuum pump to produce a vacuum.

Embodiment 6

The present embodiment is basically the same as Embodiment 5 except that the pressure inside the surrounding unit 40 is reduced and the pressure outside the surrounding unit 40 is adjusted to be the atmospheric pressure while in LP Embodiment 5, the pressure outside the surrounding unit 40 is raised and the pressure inside the surrounding unit 40 is kept at atmospheric pressure to generate the difference between the pressures outside and inside the surrounding unit 40.

The sealing apparatus 50 of the present embodiment has the construction as shown in FIG. 8 except that the pressurizing pump 53 is replaced with a vacuum pump.

In the sealing process of the present embodiment, first the vacuum pump is activated to reduce the pressure in the furnace 51, and the surrounding unit 40 is heated to soften the sealing layer 41 while the inside of the furnace 51 is kept at a low pressure.

Before the sealing layer 41 softens, gas can flow into or flow out from the surrounding unit 40. As a result, the inner space of the surrounding unit 40 is also at a reduced pressure when the sealing layer 41 softens.

After the sealing layer 41 and the adhesive 26*a* have softened, the vacuum pump is stopped so that the pressure inside the furnace 51 increases to the atmospheric pressure. At this stage, the gas flow between the inside and outside of the surrounding unit 40 has been blocked by the softened material. As a result, the pressure outside the surrounding unit 40 is higher than inside.

When the inside of the furnace 51 is cooled under the above conditions, the sealing layer 41 hardens and the surrounding unit is sealed while it is pressurized from outside.

As understood from the above description, the method of the present embodiment also provides the same effects as Embodiment 5.

Embodiment 7

In the present embodiment, a container whose inside is under a low pressure is connected to the surrounding unit, and the surrounding unit is sealed while gas is exhausted from the surrounding unit to the container to keep the pressure inside the surrounding unit low.

Figure 10:
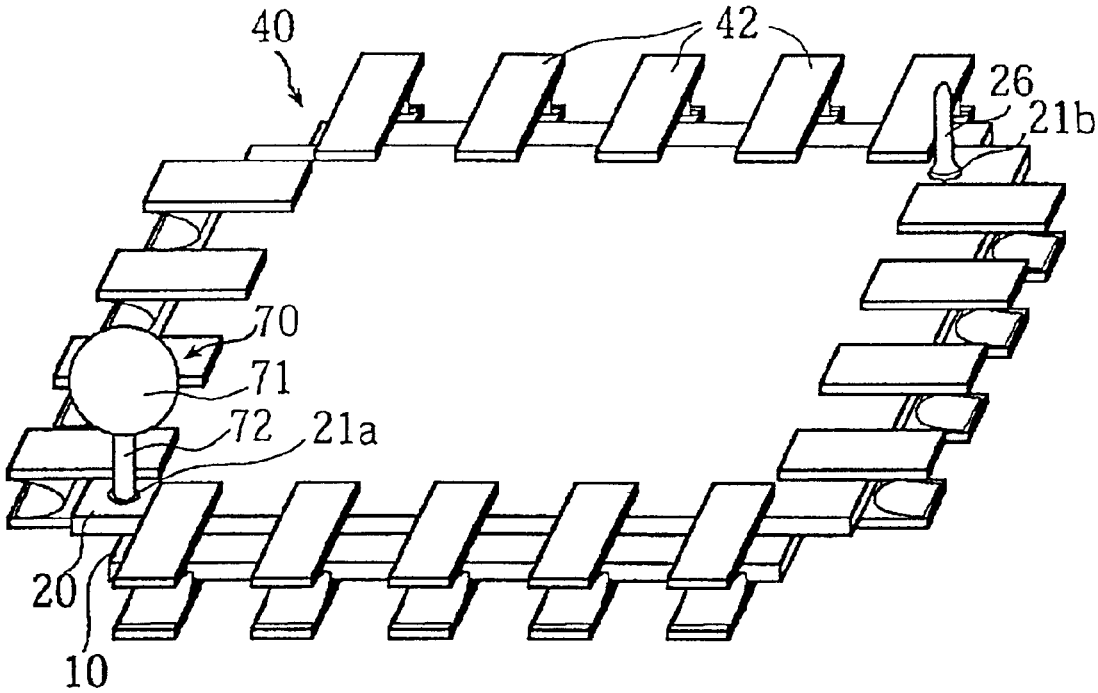
FIG. 10 is a perspective view showing the sealing process of Embodiment 7.

FIG. 10 is a perspective view showing how the surrounding unit 40 is sealed with the method of the present embodiment.

In Embodiment 1, the air vent 21*a* is opened beforehand at the rim on the back panel 20 outside the display area. In the present embodiment, an air vent 21*b* as well as the air vent 21*a* is opened at the rim.

As in Embodiment 1, the sealing layer 41 is formed at the rim of either of or both the front panel 10 and the back panel 20 on the surfaces facing each other. The front panel 10 and the back panel 20 are positioned properly to face each other and are put together to form the surrounding unit 40. The rim of the surrounding unit 40 is fastened by clips 42 so that the panels are not displaced.

A low-inner-pressure container 70 is attached to the air vent 21*a* of the surrounding unit 40. The pipe 26 of Embodiment 5 whose end is sealed off is attached to the air vent 21*b*.

The low-inner-pressure container 70 is, as the pipe 26 is, made of a glass being resistant to the sealing temperature, and is composed of: a container body 71; and a connector 72 which projects from the container body 71 so as to be connected to the air vent 21*a*. The container body 71 is airtightly sealed by a gas-flow-cut layer 73 (FIG. 13A) formed inside the connector 72 which blocks the gas flow, and the inside of the container body 71 is kept at a reduced pressure.

An adhesive 74 is previously applied to the juncture of the connector 72 and the air vent 21*a* of the back panel 20. The adhesive 26*a* is previously applied to the juncture of the pipe 26 and the air vent 21*b* of the back panel 20. These junctures are airtightly sealed by the adhesives. In the present embodiment, the material used for the sealing layer 41 is also used for the adhesives 26*a* and 74.

The material used for the sealing layer 41 or a low-melting glass whose softening point is slightly higher than the sealing layer 41 is used for the gas-flow-cut layer 73 so that the layer 73 softens almost at the same, time or after the sealing layer 41 and the adhesives 26*a* and 74 soften.

Now, a method of producing the low-inner-pressure container 70 will be described with reference to FIGS. 11A and 11B.

The container body 71 and the connector 72 are manufactured using a technique used for processing glass products such as flask. Note that the container body 71 is provided with an exhaust pipe 72*a* used for exhausting gas to produce a vacuum, aside from the connector 72.

Figure 11A:
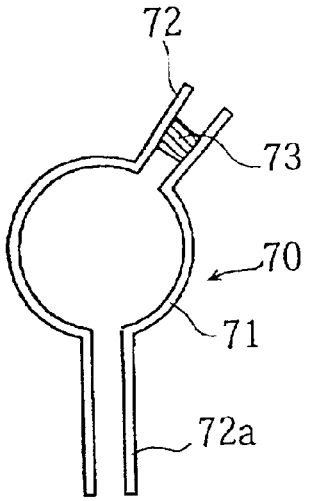
FIGS. 11A, 11B, and 11C show a method of producing the low-inner-pressure container used in the sealing process of Embodiment 7.

As shown in FIG. 11A, the connector 72 is filled with paste including a low-melting glass as the material of the gas-flow-cut layer 73. The gas-flow-cut layer 73 is formed by softening the paste using a heater such as a gas burner then hardening it again.

Figure 11B:
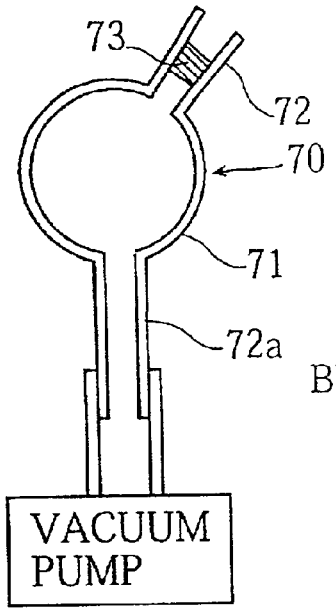

As shown in FIG. 11B, a vacuum pump is connected to the exhaust pipe 72*a*, and gas is exhausted from the container body 71 to a certain degree of vacuum using the vacuum pump.

Figure 11C:
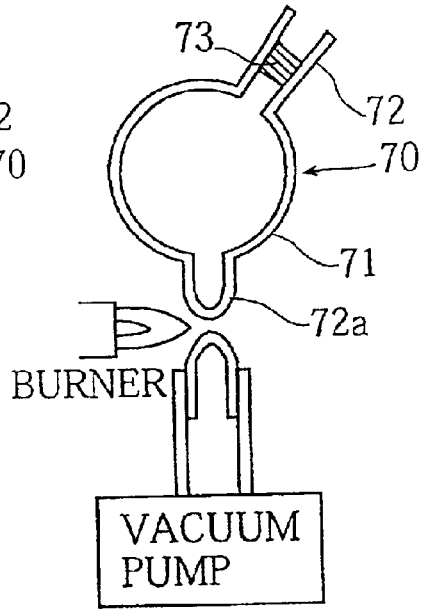

As shown in FIG. 11C, the exhaust pipe 72*a* is then chipped off using a gas burner while the certain degree of vacuum in the container body 71 is maintained, with the vacuum pump being connected to the exhaust pipe 72*a*.

The above process completes the low-inner-pressure container 70 whose container body 71 has the certain degree of vacuum.

Figure 12:
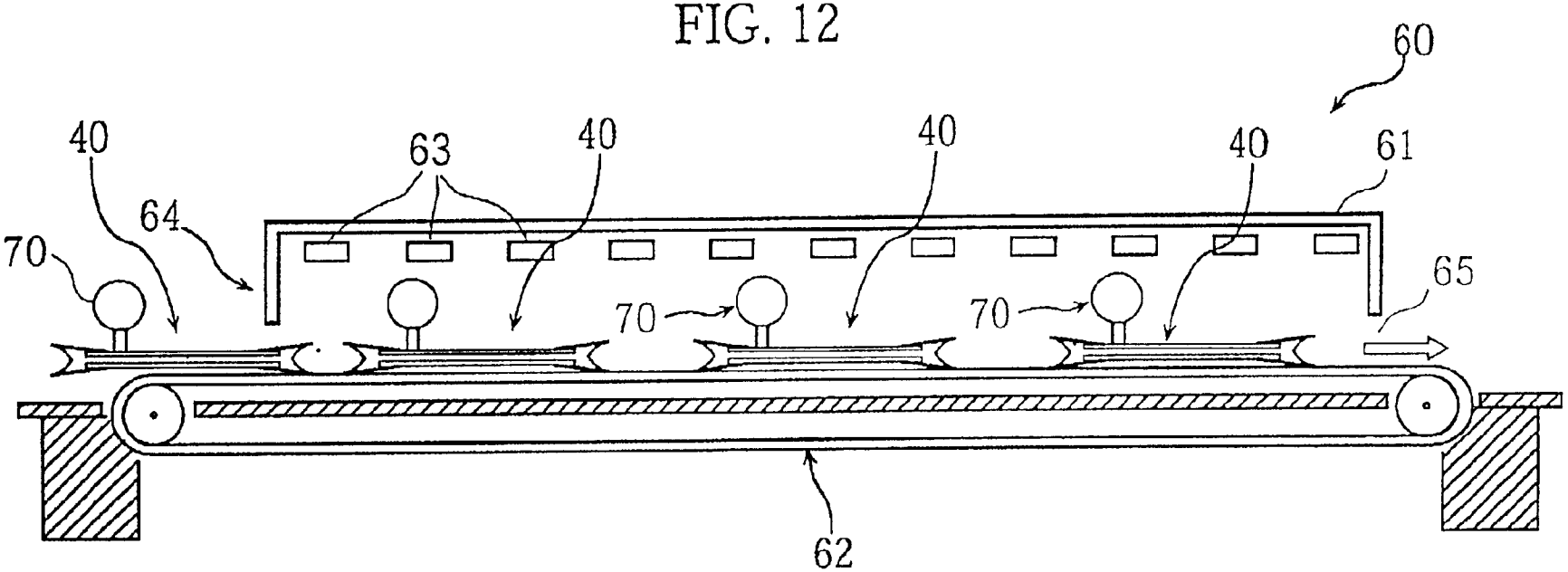
FIG. 12 shows a belt-conveyor-type heating apparatus used in the sealing process of Embodiment 7.

FIG. 12 shows a belt-conveyor-type heating apparatus used for sealing the surrounding unit 40 in the present embodiment.

A heating apparatus 60 of the belt conveyor type includes: a furnace 61 for heating the panels; a conveyor belt 62 for conveying the surrounding unit 40; and a plurality of heaters 63 disposed in the furnace 61 along the direction of conveyance.

The temperatures at a plurality of points between an entrance 64 and an exit 65 can be adjusted by the plurality of heaters 63. With this construction, the surrounding unit 40 can be heated or cooled with a desired temperature profile.

Figure 13A:
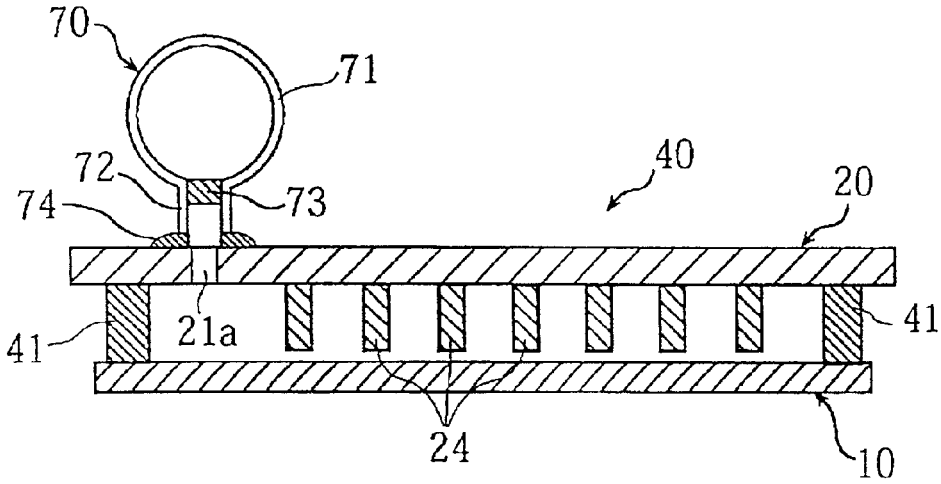
FIGS. 13A, 13B, and 13C show changes of state in the sealing process of Embodiment 7.
Figure 13B:
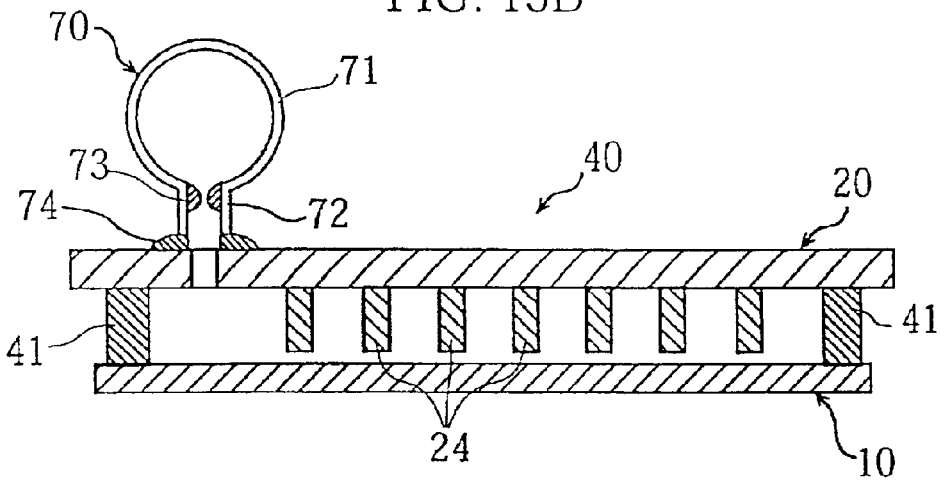
Figure 13C:
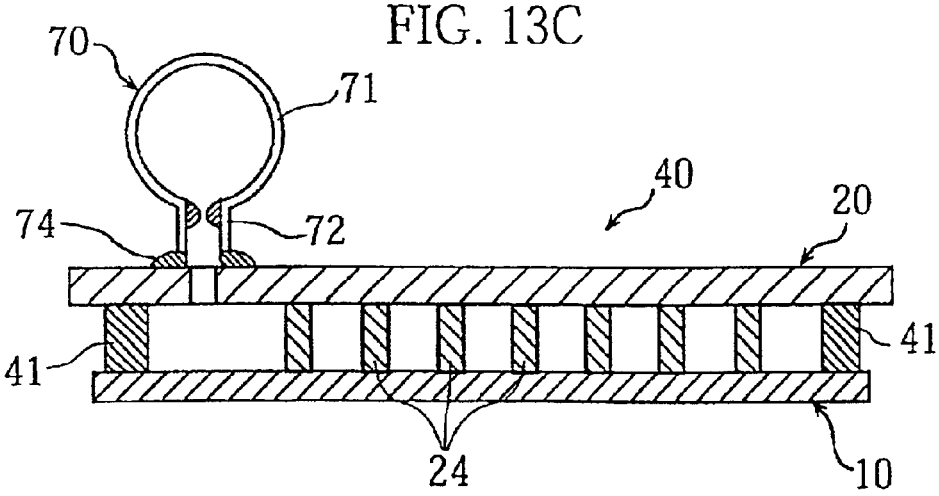

FIGS. 13A to 13C shows changes in the state of the surrounding unit 40.

The surrounding unit 40 with the low-inner-pressure container 70 and the pipe 26 is sealed as follows using the heating apparatus 60.

The surrounding unit 40 is placed on the conveyer belt 62 of the heating apparatus 60 and is conveyed in the furnace 61. The surrounding unit 40 is heated to a sealing temperature set to a degree slightly higher than the softening point of the gas-flow-cut layer 73 while conveyed in the furnace 61. The temperature increase speed in this heating is 10° C./minute, for example.

When the temperature of the surrounding unit 40 is lower than the softening point of the sealing layer 41, gas can flow into or flow out from the surrounding unit 40 via the sealing layer 41 on the other hand, as shown in FIG. 13A, the certain degree of vacuum in the container body 71 is maintained since gas flow from or to outside is blocked by the gas-flow-cut layer 73.

When the temperature of the surrounding unit 40 reaches the softening point of the sealing layer 41 by the heating, the sealing layer 41 softens. The softened sealing layer 41 airtightly seals the rims of the panels 10 and 20. At the same time, the adhesives 26*a* and 74 soften. As a result, the juncture of the low-inner-pressure container 70 and the back panel 20 and the juncture of the pipe 26 and the back panel 20 are also airtightly sealed.

The above process cuts the gas flow between the inner space of the surrounding unit 40 and outer space. More specifically, the gas flow is interrupted between the inside and outside of a container complex composed of the surrounding unit 40 and the low-inner-pressure container 70.

The gas-flow-cut layer 73 softens almost at the same time or after the sealing layer 41 softens. When this happens, since the certain degree of vacuum in the container body 71 has been maintained, the gas-flow-cut layer 73 is broken by the difference between the pressures at its opposite sides, and the gas flows into the container body 71 from the inner space of the surrounding unit 40.

This reduces the pressure in the inner space of the surrounding unit 40, and allows the panels 10 and 20 to be pressurized from outside.

This pressurization reduces the gap between the front panel 10 and the top of the barrier ribs 24, as shown in FIG. 13C.

The surrounding unit 40 is left to stand (e.g., for 30 minutes) at the sealing temperature, then cooled and moves out of the furnace 61.

When the surrounding unit 40 is cooled to a degree equal to or below the softening point of the sealing layer 41, the sealing layer 41 hardens while the panels 10 and 20 are pressurized from outside, that is, while the gap between the front panel 10 and the top of the barrier ribs 24 is small.

After the sealing process by the heating apparatus 60 ends, the connector 72 is chipped off by a burner to block the air vent 21*b*. The end of the pipe 26 is then cut, and the vacuum pipe is connected to the pipe 26. Gas is exhausted from the inner space of the surrounding unit 40 to produce a vacuum in the inner space.

Effects of Sealing Process of Present Embodiment

In the present embodiment, as in Embodiment 1, the panels 10 and 20 are bonded together while they are equally pressurized from outside. That means, the panels 10 and 20 are bonded while the front panel 10 and the top of the barrier ribs 24 are in intimate contact in entirety.

In Embodiment 1, the vacuum pump is connected to the surrounding unit 40. In Embodiments 3 to 5, the pressure inside the furnace is reduced or increased. The present embodiment does not have such requirements. With such a construction, it is easy to perform the continuous sealing processes using a continuous heating apparatus such as the heating apparatus 60.

In the process of producing the low-inner-pressure container 70, it is preferable that the capacity and the degree of vacuum of the container body 71 are determined so that the pressure in the surrounding unit 40 is in a range of 10 to 600 Torr after the gas-flow-cut layer 73 is broken. This is because; when the pressure in the surrounding unit 40 is below 10 Torr, the sealing layer 41 may be broken by the difference between the pressures at its opposite sides; and when the pressure in the surrounding unit 40 is over 600 Torr, the pressure is as weak as to provide small effects.

Variations of the Present Embodiment

In the present embodiment, the gas-flow-cut layer 73 is made of a low-melting glass so that it melts by heat during the sealing process. However, the gas-flow-cut layer 73 may be made of such a material as melts or dissolves by application of an energy such as light or ultrasonic waves. In this case, the energy such as light or ultrasonic waves is applied to the gas-flow-cut layer 73 during the sealing process.

For example, the gas-flow-cut layer 73 is made of a novolak resin, and light is shone onto the novolak resin during the sealing process. Such a process can be operated in the same way as the present embodiment, and provides the same effects.

Embodiment 8

In the present embodiment, the sealing process is performed as follows. The surrounding unit 40 is heated to a high temperature and is sealed so that gas flow between the inner space and the outer space is interrupted, then the surrounding unit 40 is cooled and the pressure in the inner space is reduced to generate the difference between the pressures outside and inside the surrounding unit 40.

Figure 14:
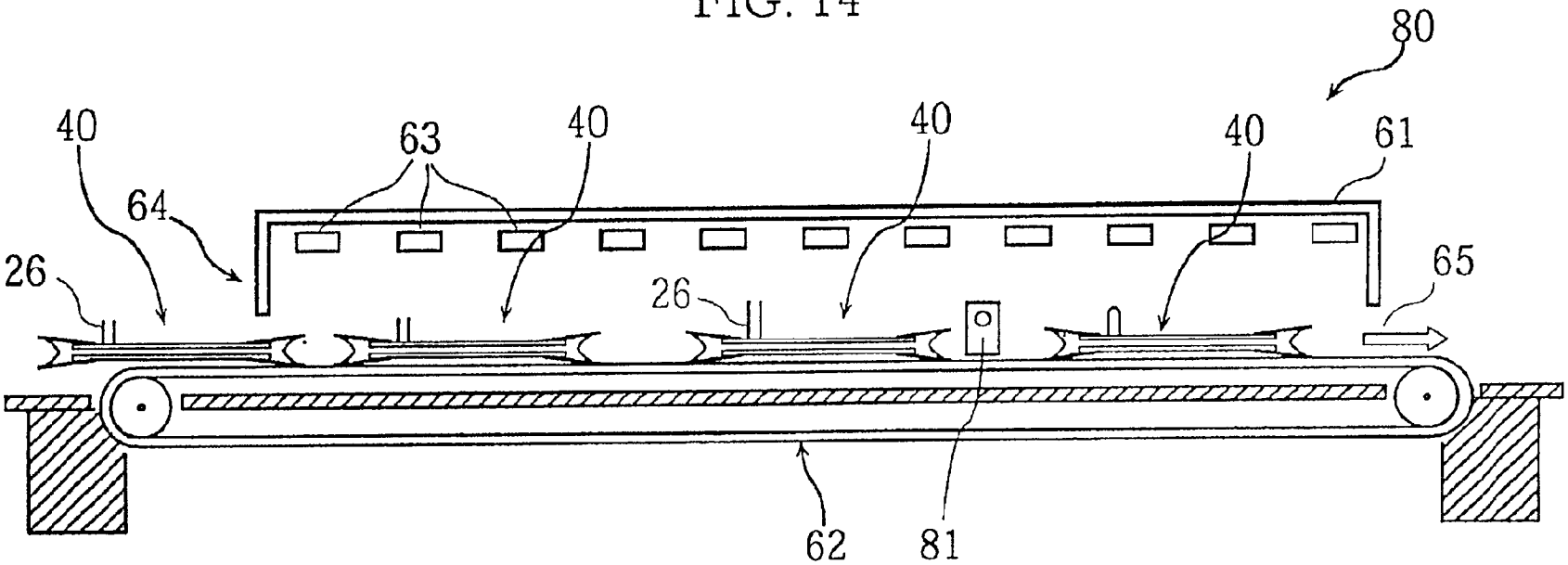
FIG. 14 shows a belt-conveyor-type heating apparatus used in the sealing process of Embodiment 8.
Figure 15:
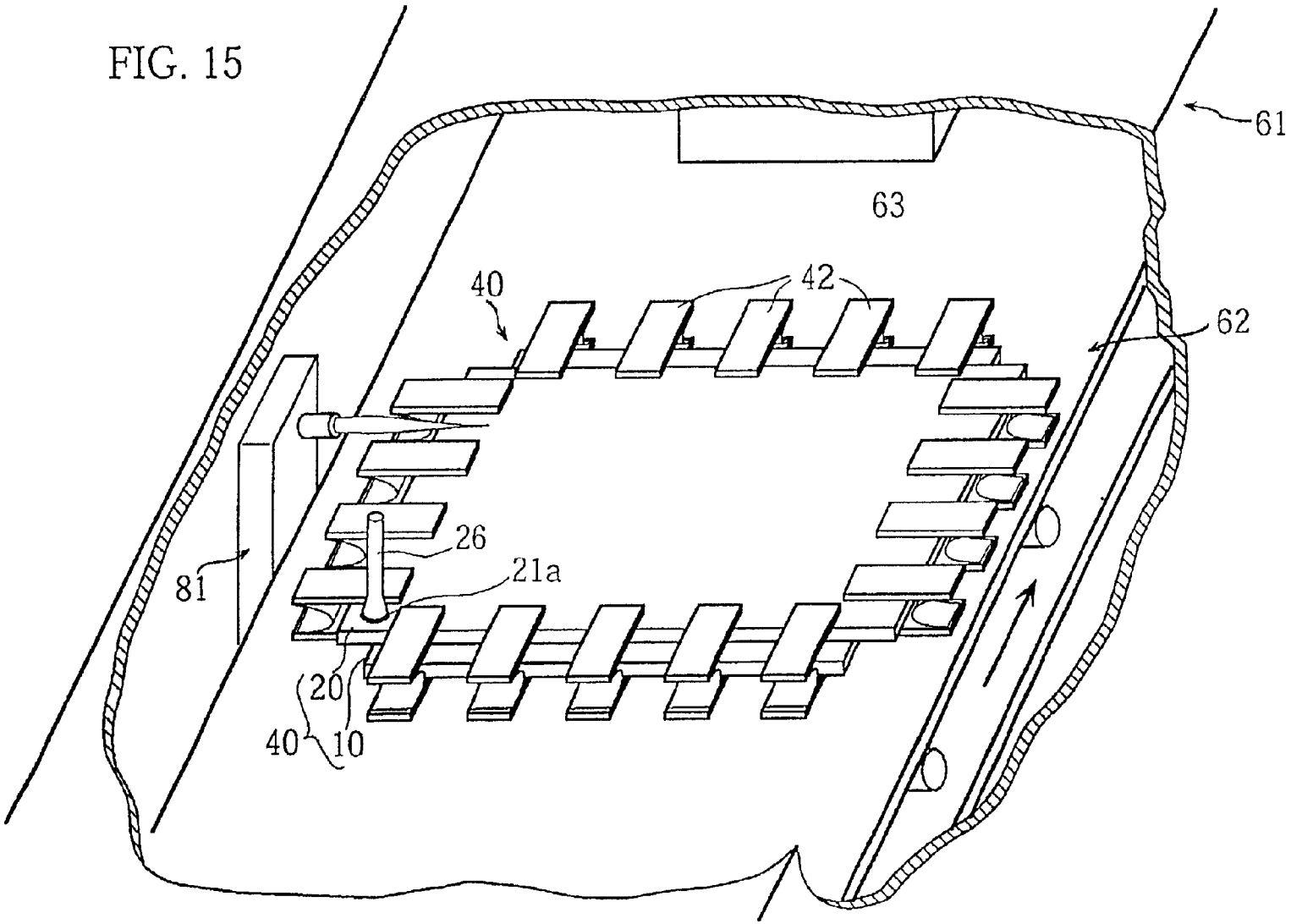
FIG. 15 shows the sealing process in which the belt-conveyor-type heating apparatus shown in FIG. 14 is used.

FIG. 14 shows a belt-conveyor-type heating apparatus used for sealing the surrounding unit 40 in the present embodiment. FIG. 15 shows the surrounding unit 40 placed in the belt-conveyor-type heating apparatus in the sealing process.

In the sealing process of the present embodiment, a linear pipe 26 whose end is opened is connected to the air vent 21*a* of the surrounding unit 40 (FIG. 15). The surrounding unit 40 is sealed using a belt-conveyor-type heating apparatus 80 shown in FIG. 14.

The heating apparatus 80 has the same construction as the heating apparatus 60 used in Embodiment 7 except that a burner 81 is disposed in the furnace 61. The burner 81 is used to heat and seal off the end of the pipe 26. The position of the burner 81 in the furnace 61 is set in an area where the surrounding unit 40 conveyed by the conveyer belt 62 in the furnace 61 reaches the highest temperature (peak temperature).

The surrounding unit 40 with the pipe 26 is sealed as follows by the heating apparatus 80.

The surrounding unit 40 is placed on the conveyer belt 62 of the heating apparatus 80 and is conveyed in the furnace 61. The surrounding unit 40 is heated to a sealing temperature (e.g., 500° C.) set to a degree higher than the softening point of the sealing layer 41 (e.g., 380° C.) while conveyed in the furnace 61. The temperature increase speed in this heating is 10° C./minute, for example.

The surrounding unit 40 is left to stand (e.g., for 10 minutes) at the peak temperature, then the end of the pipe 26 is heated and melted to be sealed off by the burner 81. At this stage, gas flow between the inner space and the outer space of the surrounding unit 40 has been interrupted since the sealing layer 41 and adhesive 26*a* have softened, as in Embodiment 5 as shown in FIG. 9B. That is, the inner space is hermetically sealed.

The surrounding unit 40 is cooled after it passes the burner 81 while conveyed in the furnace 61, then moves out of the furnace 61. The pressure in a hermetically sealed space is proportionate to the absolute temperature (Boyle-Charles' law). As a result, the pressure in the inner space of the surrounding unit 40 decreases with decreasing temperature there. This generates a difference in pressure between the inside and outside of the inner space, allowing the panels 10 and 20 to be pressurized from outside. When the surrounding unit 40 having moved out of the furnace is further cooled to the softening point of the sealing layer 41, the sealing layer 41 and the adhesive 26*a* start to harden. That means, the panels 10 and 20 are bonded with a small gap between the front panel 10 and the top of the barrier ribs 24. Also, the pipe 26 is bonded to the back panel 20.

The sealing process as above is followed by the vacuum exhaust process in which the end of the pipe 26 is cut and opened, the vacuum pump is connected to the end, and gas is exhausted from the inner space by the vacuum pump to produce a vacuum.

Effects of Sealing Process of Present Embodiment

In the present embodiment, as in Embodiment 7, the panels 10 and 20 are bonded together while they are equally pressurized from outside. That means, the panels 10 and 20 are bonded while the front panel 10 and the top of the barrier ribs 24 are in intimate contact in entirety. With such a construction, it is easy to perform the continuous sealing steps using a continuous heating apparatus such as the heating apparatus 80.

It should be noted here that to produce sufficient effects, it is required that there is a sufficient difference between the pressures outside and inside the surrounding unit 40 when the sealing layer 41 hardens. Therefore, the end of the pipe should be cut at a temperature (peak temperature) 10° C. higher than, preferably several tens ° C. higher than, the softening point of the sealing layer 41.

Variations of the Present Embodiment

In the present embodiment, the end of the pipe 26 is heated and sealed off by the burner 81 to cut the gas flow between the inside and outside of the surrounding unit 40. However, the following method can also be applied.

The end of the pipe 26 is previously filled with a low-melting glass whose softening point is slightly lower than the above peak temperature. With such an arrangement, the low-melting glass softens and seals off the end of the pipe before the surrounding unit 40 reaches the peak temperature, excluding the necessity of burning the end of the pipe with the burner 81. When the temperature of the surrounding unit 40 starts decreasing from the peak temperature, the low-melting glass at the end of the pipe soon hardens. When the temperature of the surrounding unit 40 further decreases and reaches the softening point of the sealing layer 41, a difference between the pressures outside and inside the surrounding unit 40 is produced. As a result, the effects of the present embodiment are also produced by this variation.

Alternatively, as in Embodiment 7, an air vent 21*b* as well as the air vent 21*a* may be opened in the back panel 20, and the linear pipe 26 whose end is sealed off is connected to the air vent 21*b*. Here, the air vent 21*a* remains opened, where nothing is attached to the air vent 21*a*.

When the surrounding unit 40 reaches the peak temperature, a low-melting glass whose softening point is slightly lower than the peak temperature is dripped onto the air vent 21*a* to seal off the air vent 21*a*. In this case, as in the above variation, the low-melting glass hardens soon after the temperature of the surrounding unit 40 starts decreasing from the peak temperature. When the temperature of the surrounding unit 40 further decreases and reaches the softening point of the sealing layer 41, a difference between the pressures outside and inside the surrounding unit 40 is produced. As a result, the effects of the present embodiment are also produced by this variation.

Embodiment 9

In the present embodiment, a container complex composed of a surrounding unit and a container is used. In the sealing process, the container complex is heated to a high temperature, the gas flow between the inside and outside of the container complex is interrupted at the high temperature, and the surrounding unit is cooled while the pressure inside the surrounding unit is low, resulting in the sealing of the surrounding unit.

Figure 16A:
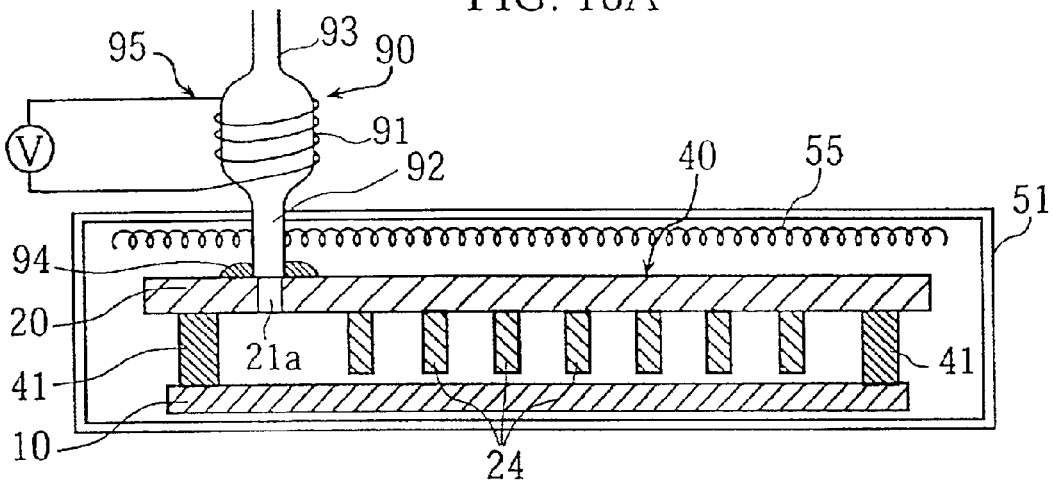
FIGS. 16A, 16B, and 16C show the sealing process of Embodiment 9.
Figure 16B:
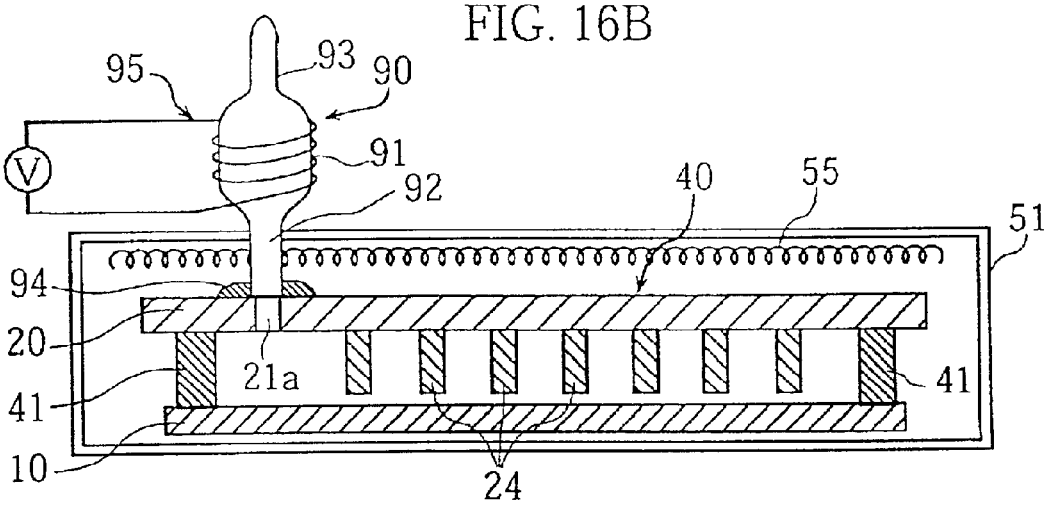
Figure 16C:
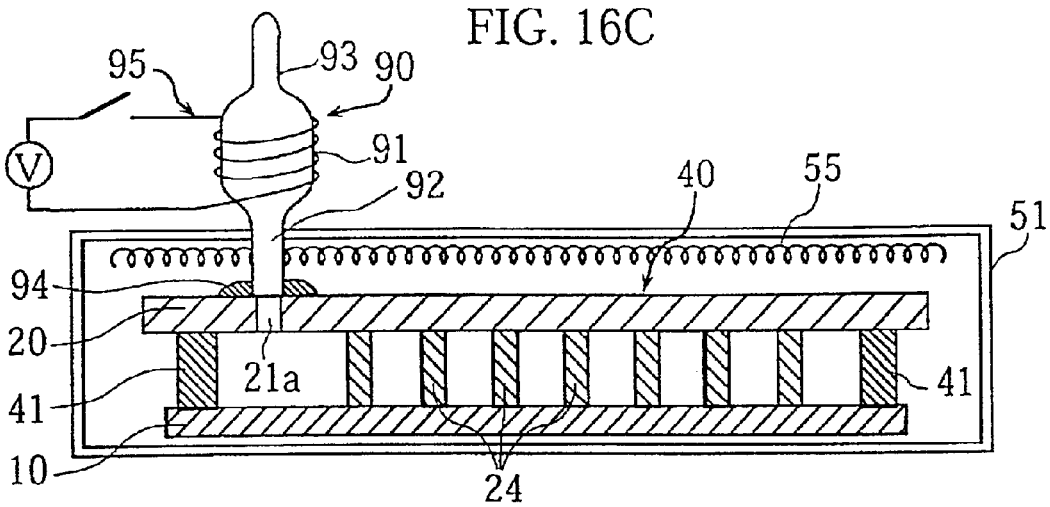

FIGS. 16A to 16C show the sealing of the surrounding unit 40 in the present embodiment.

As shown in FIG. 16A, the surrounding unit 40 including the front panel 10 and the back panel 20 put together with the sealing layer 41 in between is placed in the furnace 51, as in Embodiment 1. The settings of the present embodiment differ from Embodiment 1 in that instead of the pipe 26, a container 90 whose end is opened is attached to the air vent 21*a* of the back panel 20.

The container 90 is composed of: a container body 91; a connector 92 protruding from the container body 91 and connecting the container body 91 and the air vent 21*a*; and an extension 93 extending from the container body 91 in the direction opposite to the connector 92, with its end opened.

In the initial settings for the sealing process, the container 90 is attached to the air vent 21*a* with the container body 91 exposed outside the furnace 51. An adhesive 94 is applied beforehand between the connector 92 and the back panel 20 so that the juncture of the container 90 and the back panel 20 is airtightly sealed. In the present embodiment, the same material used for the sealing layer 41 is used as the adhesive 94.

An electric heater 95 for heating the container body 91 is attached to the container body 91.

After the above initial settings are complete, the surrounding unit 40 is heated in the furnace 51 to a temperature (e.g., 480° C.) higher than the softening point of the sealing layer 41 (The temperature increase speed in this heating is 10° C./minute, for example). At the same time, the container body 91 is heated by the electric heater 95 to a chosen temperature (e.g., 200° C.). The end of the extension 93 is then sealed off by the burner.

Here, as shown in FIG. 16B, the end of the extension 93 has been sealed off, and the sealing layer 41 and the adhesive 94 have softened. As a result, the gas flow between the inside and outside of the surrounding unit 40 and the gas flow between inside and outside (space in the furnace 51) of the container body 91 have been interrupted.

The electric heater 95 is then powered off to cool the container body 91 while the surrounding unit 40 is kept at a temperature higher than the softening point of the sealing layer 41 in the furnace 51, as shown in FIG. 16C.

The decrease in the temperature of the container body 91 leads to the decrease in the pressure in the container body 91, which leads to the decrease in the pressure in the surrounding unit 40. Therefore, as in Embodiment 8, a difference between the pressures outside and inside the surrounding unit 40 is produced. This allows the panels 10 and 20 to be pressurized from outside.

The temperature inside the furnace 51 is then decreased. The sealing layer 41 and the adhesive 94 harden when LP the surrounding unit 40 is cooled to the softening point of the sealing layer 41. That means, the panels 10 and 20 are bonded with a small gap between the front panel 10 and the top of the barrier ribs 24. Also, the container 90 is bonded to the back panel 20.

The sealing process as above is followed by the vacuum exhaust process in which the end of the extension 93 is cut and opened, the vacuum pump is connected to the end, and gas is exhausted from the inner space by the vacuum pump to produce a vacuum.

Effects of Sealing Process of Present Embodiment

In the present embodiment, as in Embodiment 8, the panels 10 and 20 are bonded together while the front panel 10 and the top of the barrier ribs 24 are in intimate contact in entirety.

In Embodiment 8, the surrounding unit 40 itself is cooled to decrease the pressure, while in the present embodiment, the pressure in the inner space of the surrounding unit 40 is reduced by decreasing the temperature of the container 90 which is arranged so that its temperature can be separately adjusted. As a result, unlike Embodiment 8, the surrounding unit 40 need not be heated to a temperature much higher than the softening point of the sealing layer 41. In the present embodiment, it will be sufficient for the surrounding unit 40 to be heated to a temperature equal to or higher than the softening point of the sealing layer 41.

Embodiment 10

In the present embodiment, a continuous heating apparatus is used to heat the container complex described in Embodiment 9. In the sealing process, the container complex is heated to a high temperature, the gas flow between the inside and outside of the container complex is interrupted at the high temperature, and the surrounding unit is cooled while the pressure inside the surrounding unit is low, resulting in the sealing of the surrounding unit.

Figure 17:
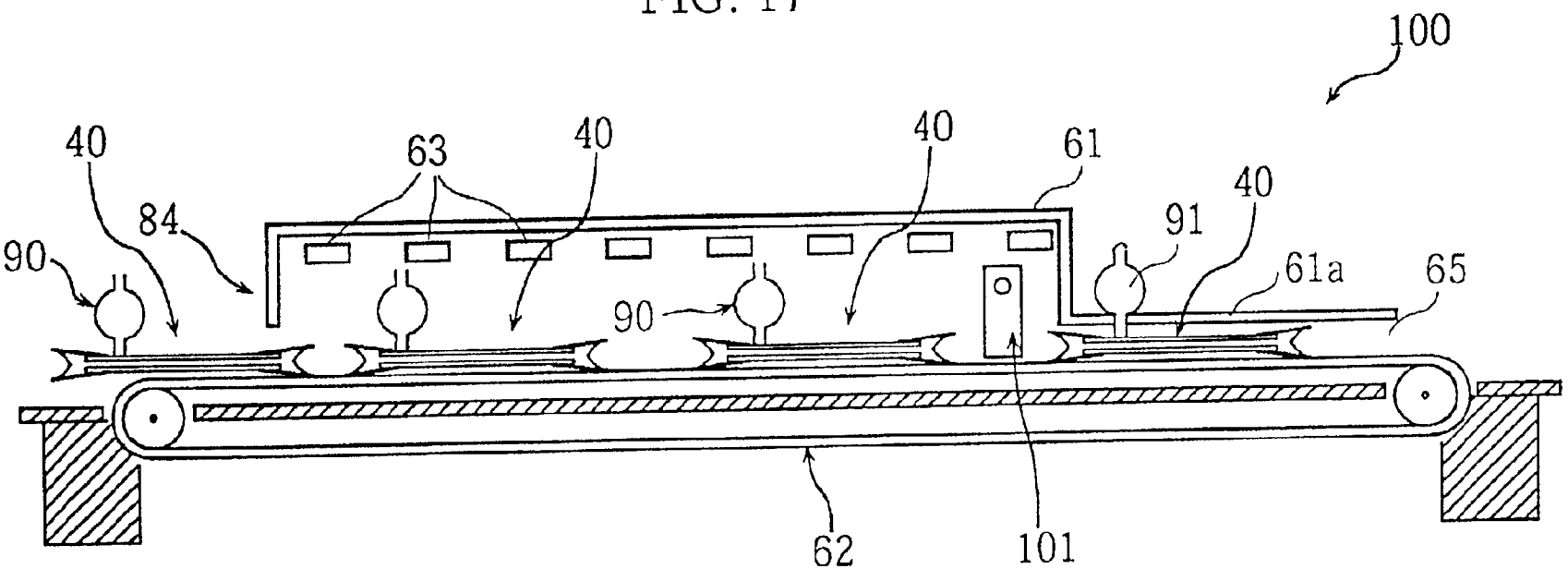
FIG. 17 shows a belt-conveyor-type heating apparatus used in Embodiment 10.
Figure 18:
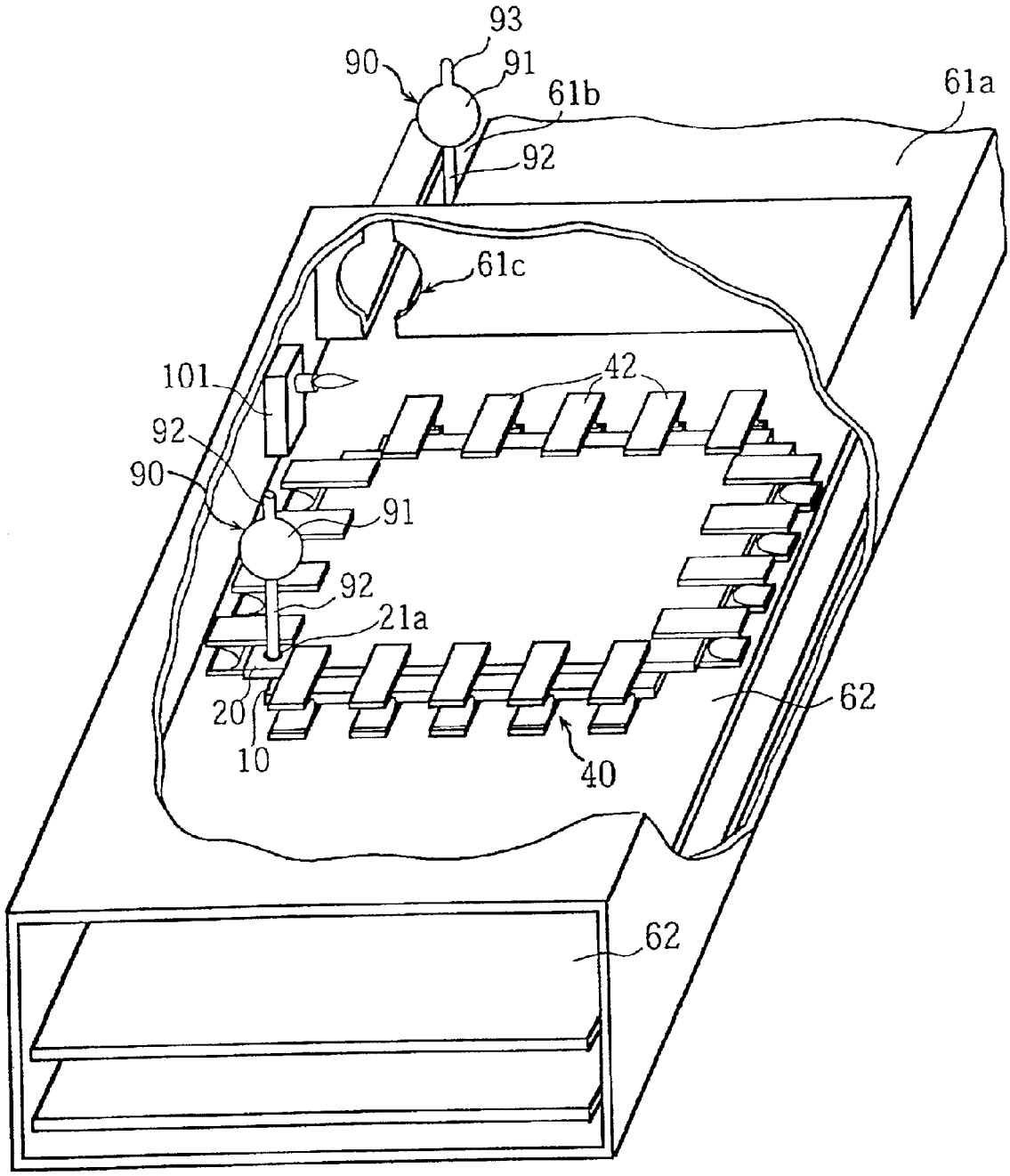
FIG. 18 shows the sealing process in which the belt-conveyor-type heating apparatus shown in FIG. 17 is used.
Figure 19:
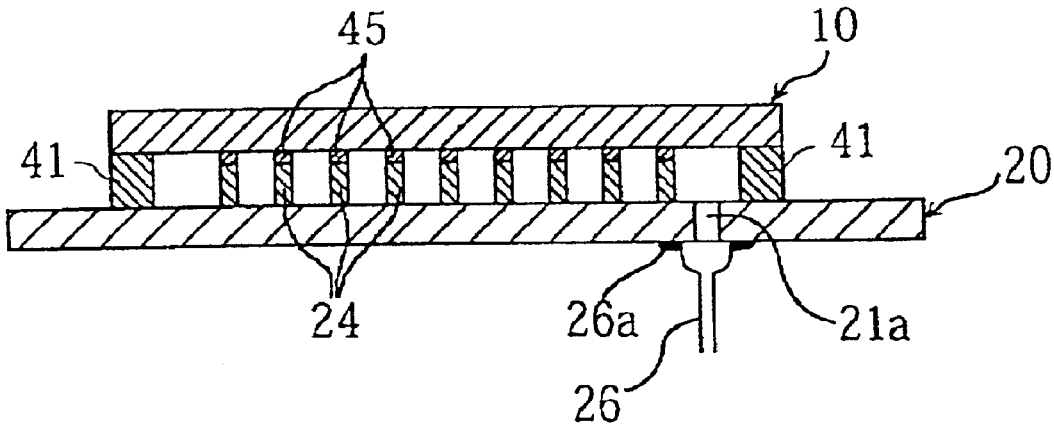
FIG. 19 shows the sealing process of Embodiment 11.

FIG. 17 shows a belt-conveyor-type heating apparatus used for sealing the surrounding unit 40 in the present embodiment. FIG. 18 shows the surrounding unit 40 placed in the belt-conveyor-type heating apparatus in the sealing process.

In the sealing process of the present embodiment, as in Embodiment 8, the surrounding unit 40 to which the container 90 is attached via the air vent 21*a* by the adhesive 94 is heated while conveyed in the heating apparatus 100 so that the surrounding unit 40 is sealed, as shown in FIG. 17.

The heating apparatus 100 has the same construction as the heating apparatus 80 used in Embodiment 8 except that a burner 101 for sealing off the end of the extension 93 of the container 90 is disposed in the furnace 61. The position of the burner 101 in the furnace 61 is set in an area where the surrounding unit 40 conveyed by the conveyer belt 62 in the furnace 61 reaches a temperature equal to or higher than the sealing temperature (the softening point of the sealing layer 41).

In the heating apparatus 100, a ceiling plate 61*a* is lowered in height between the burner and the exit. The ceiling plate 61*a* has a slot 61*b* so that the connector 92 of the container 90 can pass through it as the surrounding unit 40 is conveyed on the belt. The ceiling plate 61*a* also has a window 61*c* so that the container body 91 can pass through it as the surrounding unit 40 is conveyed on the belt.

The surrounding unit 40 with the container 90 is placed on the conveyer belt 62 of the heating apparatus 100 and is conveyed in the furnace 61. The surrounding unit 40 is heated to a sealing temperature, and is left to stand for a while at the sealing temperature. At the same time, the end of the extension 93 is heated to be sealed off by the burner 101.

At this stage, the surrounding unit 40 is in the same state as that shown in FIG. 16B of Embodiment 9. That is, the end of the extension 93 has been sealed off, and the sealing layer 41 and the adhesive 94 have softened. As a result, the gas flow between the inside and outside of the surrounding unit 40 and the gas flow between inside and outside of the container body 91 have been interrupted.

After passing the burner 101, the surrounding unit 40 is maintained at a temperature equal to or higher than the softening point of the sealing layer 41 since it moves inside the furnace 61, while the container body 91 is cooled after passing the window 61*c* since it is out of the furnace 61 (above the ceiling 61*a*).

The decrease in the temperature of the container body 91 leads to the decrease in the pressure in the container body 91, which leads to the decrease in the pressure in the surrounding unit 40, as in the state in Embodiment 9 shown in FIG. 16C. This produces a difference between the pressures outside and inside the surrounding unit 40, allowing the panels 10 and 20 to be-pressurized from outside.

The sealing layer 41 and the adhesive 94 harden when the surrounding unit 40 is cooled to the softening point of the sealing layer 41. That means, the panels 10 and 20 are bonded with a small gap between the front panel 10 and the top of the barrier ribs 24. Also, the container 90 is bonded to the back panel 20. The surrounding unit 40 then moves out of the furnace 61.

The sealing process as above is followed by the vacuum exhaust process in which the end of the extension 93 is cut and opened, the vacuum pump is connected to the end, and gas is exhausted from the inner space by the vacuum pump to produce a vacuum.

It is preferable in maintaining the temperature in the furnace 61 that the window 61*c* is provided with a shutter and that the shutter is opened only when the container body 91 passes through the window 61*c*.

Variations of Methods for Reducing Pressure in Inner Space

In Embodiments 9 and 10, the end of the extension 93 is initially opened, then it is sealed off by a burner after the container body 91 is heated so that the gas flow between the inside and outside of the surrounding unit 40 and the gas flow between inside and outside of the container body 91 are interrupted. However, if the end of the extension 93 is initially sealed off, this can also be achieved by heating the container body 91 before the sealing layer 41 softens, and cooling the container body 91 after the sealing layer 41 softens. With this method, the pressure in the inner space is also reduced.

In Embodiments 8 to 10, the surrounding unit 40 is cooled or the container 90 connected to the surrounding unit 40 is cooled to reduce the pressure in the inner space of the surrounding unit 40. However, this may be achieved by reducing the number of gas molecules in the inner space.

For example, an oxygen gas is previously encapsulated into the surrounding unit 40 or the container 90 connected to the surrounding unit 40. A laser beam is shone onto the oxygen gas when the sealing layer 41 has softened. The oxygen gas then turns to ozone, reducing the number of gas molecules contained in the inner space. This also reduces the pressure in the inner space of the surrounding unit 40.

Alternatively, a gas adsorbing material (e.g., getter) and a gas are initially enclosed in the surrounding unit 40 or the container 90 connected to the surrounding unit 40, where the gas adsorbing material is activated when it is given a stimulus such as heat or light, and the gas is held by adsorption on the surface of the gas adsorbing material when the material is activated. It is possible with this construction to reduce the number of gas molecules contained in the inner space of the surrounding unit 40 and the pressure therein by making an arrangement so that the gas adsorbing material is activated when the sealing layer 41 has softened.

To achieve the above, such a gas adsorbing material as is activated at a temperature higher than the softening point of the sealing layer 41 may be used. Alternatively, a laser beam may be shone onto the gas adsorbing material so as to activate it when the sealing layer 41 has softened.

Embodiment 11

The present embodiment is basically the same as Embodiment 1 except that a joint layer 45 is formed on top of the barrier ribs 24 on the back panel 20 before the surrounding unit 40 is formed. The joint layer 45 joints the barrier ribs 24 and the front panel 10.

The material for the joint layer 45 should not badly affect the operation of the PDP and needs to have an ability to joint the barrier ribs 24 and the front panel 10. In the present embodiment, a low-melting glass used for the sealing layer 41 is used.

The joint layer 45 is formed by applying a paste containing the joint material (low-melting glass) to the top of the barrier ribs 24 with the screen printing method, then baking the applied paste.

First, the joint layer 45 is formed as described above. A difference between the pressures outside and inside the surrounding unit 40 is then generated so that the pressure inside is lower than the pressure outside, as in Embodiment 1. This renders the panels 10 and 20 equally pressurized from outside. At this stage, the front panel 10 and the top of the barrier ribs 24 are in intimate contact in entirety. When the sealing layer 42 and the joint layer 45 harden under this condition, the front panel 10 and the top of the barrier ribs 24 are tightly jointed.

The PDPs manufactured with the method of the present embodiment, in which the front panel 10 and the top of the barrier ribs 24 are jointed in entirety, are more excellent than those of Embodiment 1 in terms of the effects of restricting the vibration at PDP activation and of improving PDP display quality.

In the present embodiment, a technique of previously forming the joint layer 45 on top of the barrier ribs 24 is described based on Embodiment 1. However, the technique can also be applied to Embodiments 2 to 10. When the joint layer 45 is formed on top of the barrier ribs 24 in Embodiments 2 to 10, the PDPs manufactured with these methods are more excellent than those of Embodiments 2 to 10 in terms of the effects of restricting the vibration at PDP activation and of improving PDP display quality since the front panel 10 and the top of the barrier ribs 24 are jointed in entirety and it is possible for the inner space to be filled with the discharge gas at a high pressure.

Embodiment 12

Figure 20A:
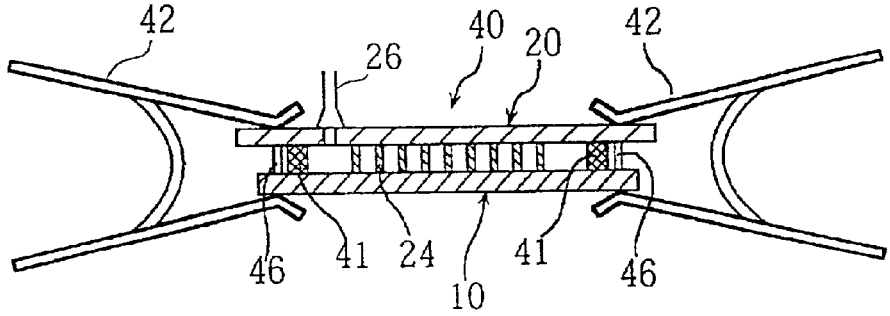
FIGS. 20A, 20B, 20C, and 20D show the sealing process of Embodiment 12.
Figure 20B:
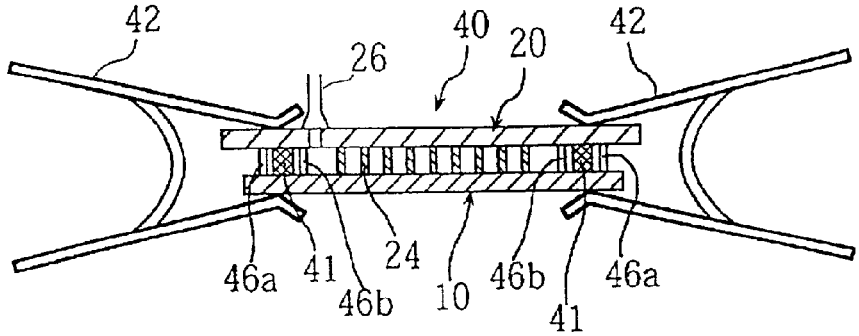

The present embodiment is basically the same as Embodiment 1 except that before the sealing process, an anti-deformation rib 46 is formed near the area where the sealing layer 41 is to be formed at the rim on either of or both the front panel 10 and the back panel 20, as shown in FIGS. 20A and 20B.

In an example shown in FIG. 20A, the anti-deformation rib 46 is formed along outside the sealing layer 41. In an example shown in FIG. 20B, the anti-deformation ribs 46*a* and 46*b* are formed along outside and inside the sealing layer 41, respectively.

With such arrangements, the panels 10 and 20 are prevented from becoming deformed even if they are pressurized at their rims by the clips 42.

When such anti-deformation ribs are not formed near the sealing layer 41, the pressure given by the clips 42 acts on the panels 10 and 20 as follows when the sealing layer 41 softens during the sealing process. As shown in FIG. 20D, at the rim of the surrounding unit 40, the panels 10 and 20 tend to deform by approaching each other (in the direction indicated by arrow A in the drawing). When this happens, the panels 10 and 20 tend to deform at the center by distancing from each other (in the direction indicated by arrow B in the drawing) by the action of a lever. Such actions are not preferable since they widen the gap between the front panel and the top of the barrier ribs 24.

On the other hand, when the anti-deformation ribs 46 are formed as described above, deformation of the panels 10 and 20 by the pressure of the clips 42 does not occur even if the sealing layer 41 softens during the sealing process.

Accordingly, it is possible to enhance the effect of reducing the gap between the front panel 10 and the top of the barrier ribs 24.

Figure 20C:
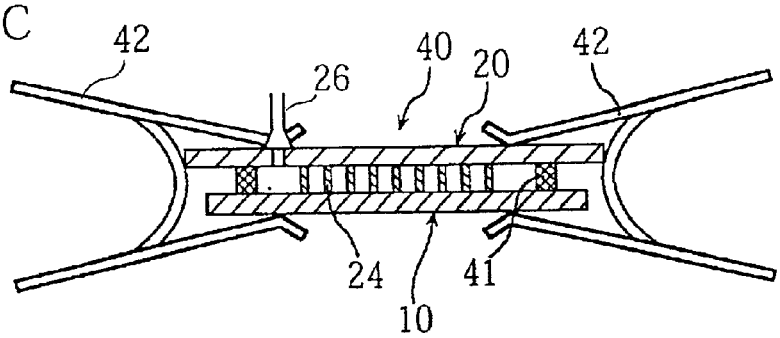
Figure 20D:
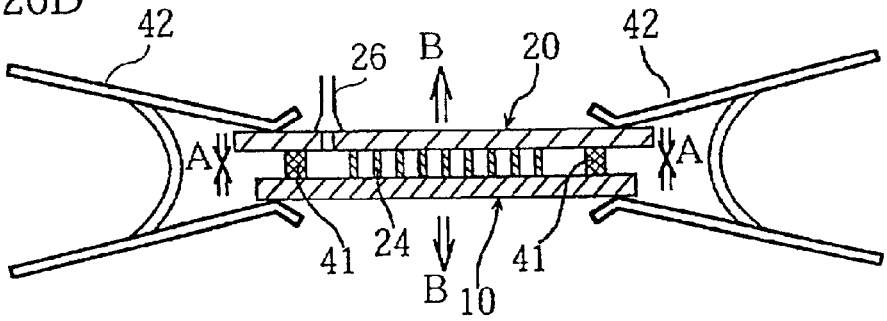

Alternatively, the deformation of the panels 10 and 20 by the pressure of the clips 42 can be prevented by arranging the clips 42 so that the pressurizing point of each clip is placed inside the edge of the panels, more specifically, so that the clips 42 pressurize the image display area, as shown in FIG. 20C.

Note that the example shown in FIG. 20B, in which the anti-deformation rib is formed along inside the sealing layer 41 as well as outside, also has an effect of preventing the softened sealing layer 41 from flowing into the display area when the pressure outside becomes higher than the pressure inside. That is to say, the anti-deformation rib 46*b* also serves as the anti-sealing-material-inflow rib 44 described in Embodiment 3.

It is preferable that the anti-deformation rib 46 is formed to have the same height as the barrier ribs 24 when the panels 10 and 20 are put together to face each other.

This is because: when the rib 46 is higher than the barrier ribs 24, a gap is generated between the front panel 10 and the top of the barrier ribs 24; and when the rib 46 is much lower than the barrier ribs 24, the effect of preventing the deformation of the panels 10 and 20 cannot be expected.

An easy way to form the anti-deformation rib 46 is to form it using the same material as, and simultaneously with, the barrier ribs 24 on the back glass substrate 21 of the back-panel 20, as the anti-sealing-material-inflow rib 44 is formed.

FIGS. 21A to 21F are partial front views showing the shapes the anti-deformation rib 46 formed on the pack panel 20. In the drawings, the diagonally shaded areas C represent the areas in which the sealing layer 41 is to be formed.

Figure 21A:
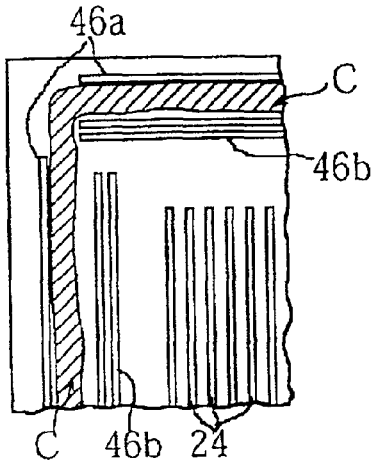
FIGS. 21A to 21F are partial front views showing specific shapes of the anti-deformation rib used in Embodiment 12.

In FIG. 21A, anti-deformation ribs 46*a* and 46*b* are formed as linear lines along outside and inside the diagonally shaded area C.

Figure 21B:
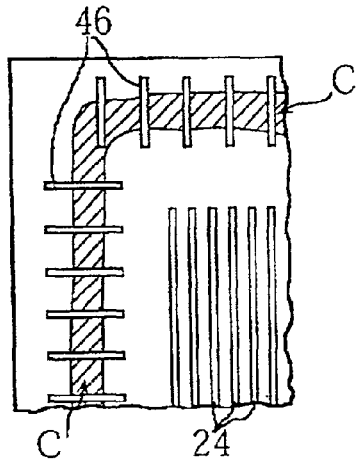

In FIG. 21B, a plurality of anti-deformation ribs are formed at regular intervals in the diagonally shaded area C, crossing over them.

Figure 21C:
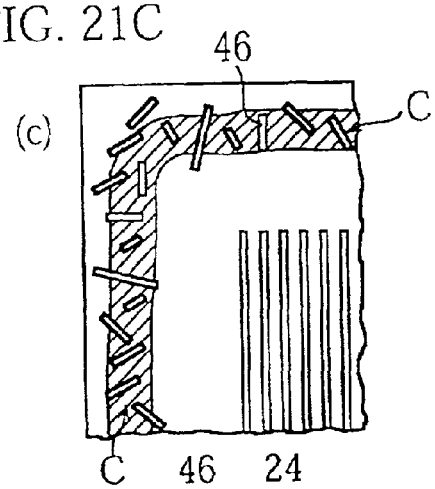

In FIG. 21C, a plurality of anti-deformation ribs are formed at random in the diagonally shaded area C.

Figure 21D:
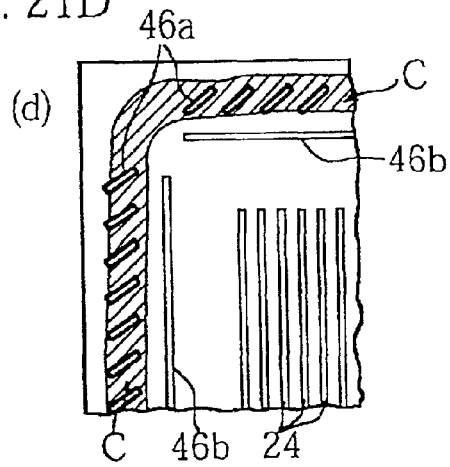

In FIG. 21D, a plurality of short anti-deformation ribs 46*a* are formed diagonally at regular intervals in the diagonally shaded area C, and anti-deformation ribs 46*b* are formed as linear lines along inside the area C.

Figure 21E:
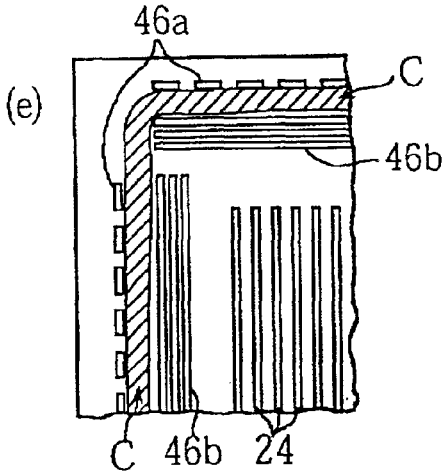

In FIG. 21E, anti-deformation ribs 46*a* are formed as short dashed lines along outside the diagonally shaded area C, and anti-deformation ribs 46*b* are formed as linear lines along inside the area C in parallel.

Figure 21F:
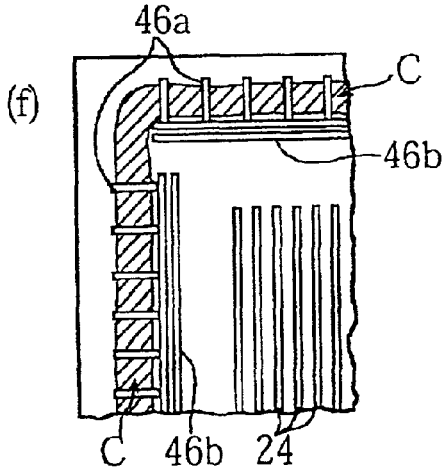

In FIG. 21F, a plurality of anti-deformation ribs 46*a* are formed at regular intervals in the diagonally shaded area C, crossing over them, and anti-deformation ribs 46*b* are formed as linear lines along inside the area C in parallel.

Variations of the Present Embodiment

The techniques disclosed in the above embodiments such as the techniques of forming the anti-deformation ribs 46 or the techniques of pressurizing the image display area by the clips 42 can be applied to general sealing processes for manufacturing PDPs, not limited to the sealing process in which a difference between the pressures outside and inside the surrounding unit 40 is generated so that the pressure inside is lower than the pressure outside.

Embodiment 13

In the present embodiment, an energy is intensively radiated onto the top of the barrier ribs to bond the top of the barrier ribs to the front panel after the sealing process is performed in a manner described in one of Embodiments 1 to 10.

Figure 22A:
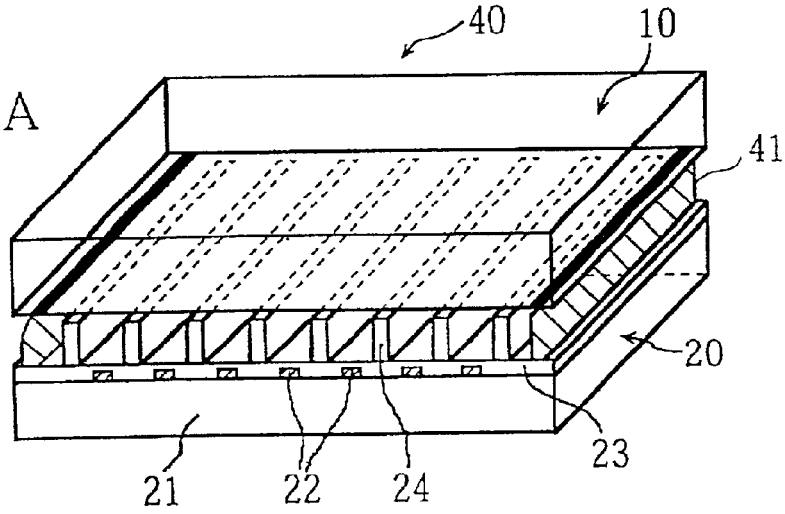
FIGS. 22A, 22B, and 22C show the process of bonding the top of the barrier ribs to the front panel by radiating a laser beam in Embodiment 13.
Figure 22B:
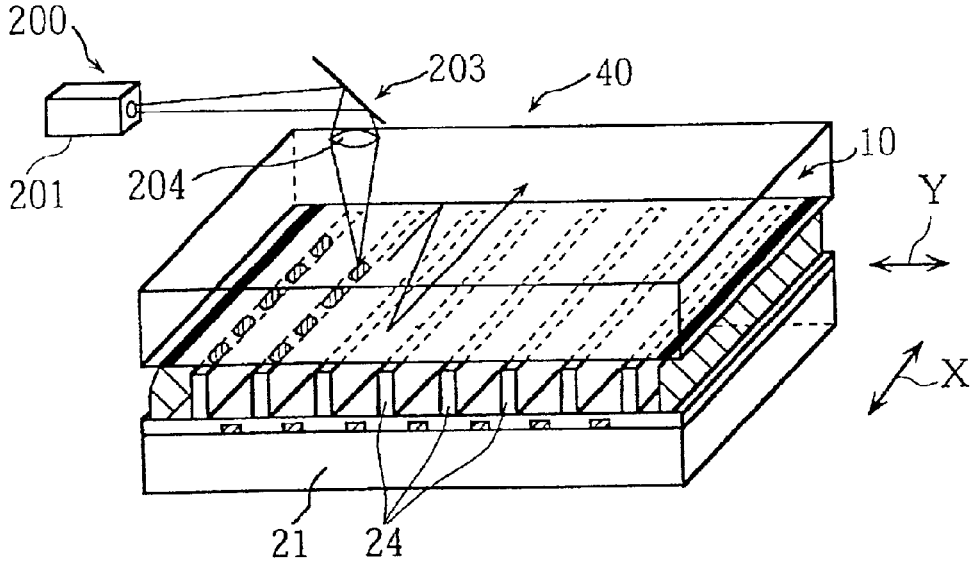
Figure 22C:
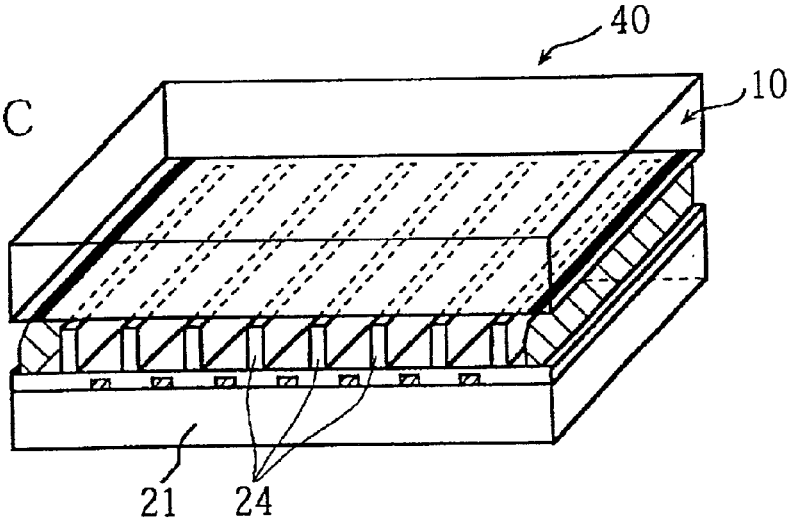

FIGS. 22A to 22C show the process of bonding the top of the barrier ribs to the front panel by radiating a laser beam.

First, the front panel 10 and the back panel 20 are put together to form the surrounding unit 40, and the panels are bonded together by softening and then hardening the sealing layer 41, using a method among those described in Embodiments 1 to 10 (FIG. 22A).

Secondly, as shown in FIG. 221, a laser beam is radiated from a laser processing apparatus 200 onto the top of the barrier ribs via the front panel 10 of the surrounding unit 40 having been formed.

As will be described later in detail, the laser processing apparatus 200 includes a plurality of components which operate to radiate a laser beam as follows. A YAG laser oscillator 201 emits pulses of a laser beam to a laser head 203, while the laser head 203 scans a work (surrounding unit 40) vertically and horizontally (in the directions X and Y shown in FIG. 22B). A converging lens 204 disposed in the laser head 203 converges the laser beam on the surface of the work as an elliptical spot.

When a laser beam is radiated onto the top of the barrier ribs, the top is intensely heated to a high temperature higher than the softening point (e.g., 500–600° C.) of the barrier rib material. When this happens, the material softens (melts) and hardens later. This allows the front panel and the top of the barrier ribs to bond together since they have been in intimate contact by this time.

Accordingly, the front panel and the top of the barrier ribs are bonded together in entirety by moving the spot of the radiated laser beam on the top of the barrier ribs along the direction of the length of the surrounding unit 40 by scanning the top in the direction as indicated by the arrow sign in FIG. 22B (the diagonally shaded area in the drawings indicate the bonded area).

FIG. 22C shows a sequence of dot-like bonded areas (the diagonally shaded areas in the drawing) which are formed by radiating the laser beam intermittently. However, the bonded areas may be formed as straight lines by radiating the laser beam with very short dashes or by radiating continuously.

The front panel and the top of the barrier ribs can be bonded together by radiating a laser beam as described above even if there is no difference between the pressures outside and inside the surrounding unit 40. However, it is preferable to perform this process maintaining the state in which the pressure of the inner space of the surrounding unit 40 is lower than the pressure outside as described in the sealing process of Embodiments 1–5 and 7–10. This is because the front panel and the top of the barrier ribs are bonded together while they are in intimate contact.

Figure 23:
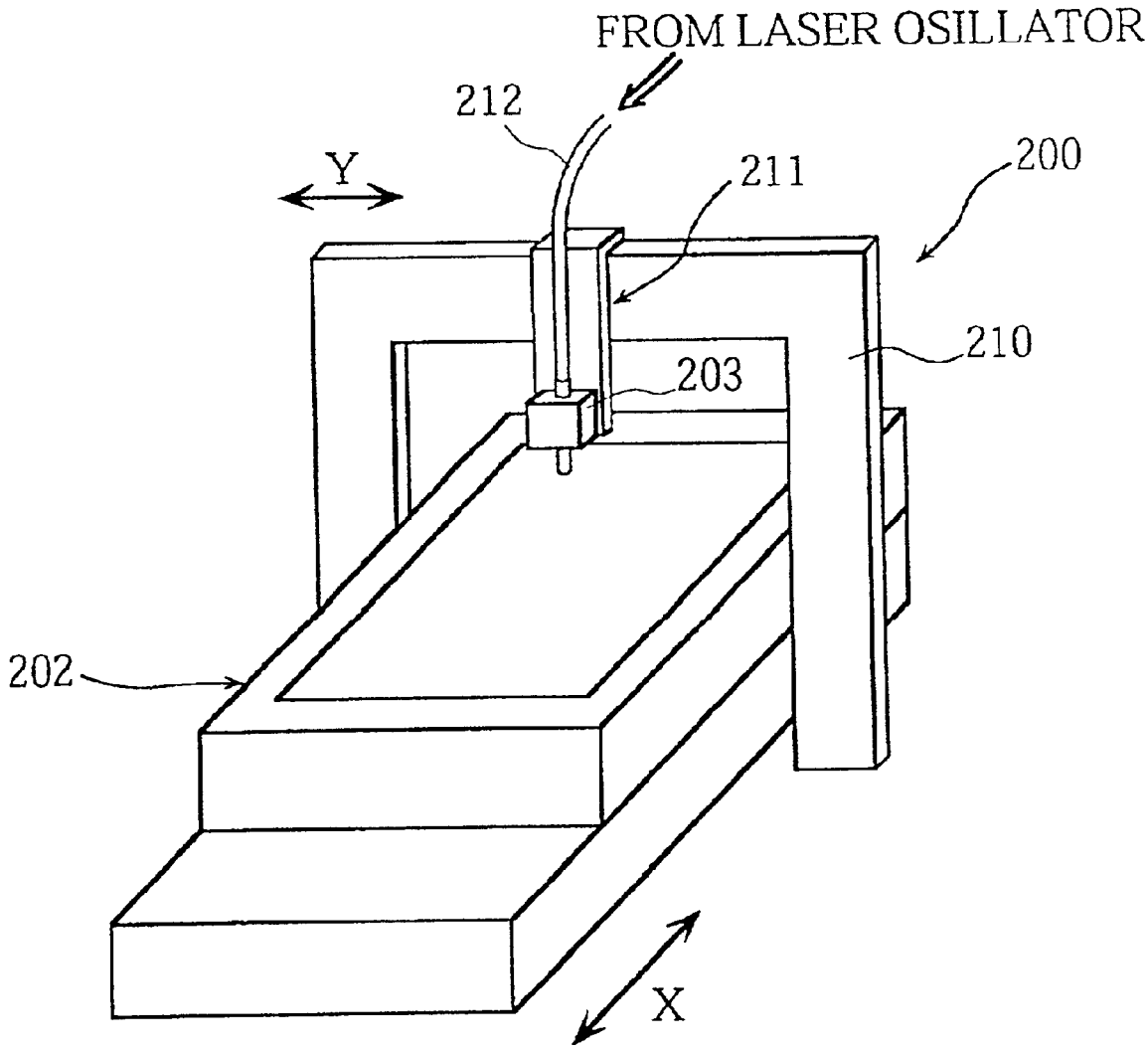
FIG. 23 is a perspective view showing a specific laser processing apparatus used in Embodiment 13.

FIG. 23 is a perspective view showing a specific laser processing apparatus 200.

The laser processing apparatus 200 shown in FIG. 23 is classified as gantry-type. In this laser processing apparatus 200, a table 202 is supported to be able to move in the X direction as shown in FIG. 23. An arch 210 is formed to overstride the table 202. A laser torch 211 is supported on the arch 210 to be able to move in the Y direction. The laser torch 211 and the table 201 are precisely driven by a stepping motor (not illustrated).

The surrounding unit 40 is fixed on the table 202 by a vacuum chuck mechanism.

The laser head 203 is fixed on the laser torch 211. The laser beam emitted from the laser oscillator 201 is guided to the laser head 203 via an optical fiber cable 212 made of quartz glass. Preferably, the laser oscillator 201 is achieved by: a YAG laser oscillator 201 which can emit a strong beam in a short time; or a $CO_2$ laser oscillator. The output of the laser oscillator 201 is 10 mW, for example.

First, the surrounding unit 40 is loaded on the table 202 so that each barrier rib extends along the X direction shown in FIG. 23. The first barrier rib is then bonded to the front panel by moving the spot of the radiated laser beam on the top of the barrier rib in the X direction. The spot is moved by the pitch of the barrier ribs in the Y direction. This process is repeated for the rest of the barrier ribs until the entire top of the barrier ribs is bonded.

Effects of Present Embodiment

In the present embodiment, the front panel and the top of the barrier ribs are bonded together in entirety. As a result, the effects of restricting the vibration at PDP activation and of improving PDP display quality are as excellent as Embodiment 11.

The results of experiments performed by driving the PDPs manufactured with the method of the present embodiment show that the resonance of the barrier ribs and the front panel does not occur, while it occurs to conventional products. Also, the results show that the noise level of the PDPs of the present embodiment is one-tenth of conventional products, and that no cross talk between cells is objected.

The present embodiment has another advantage that, unlike Embodiment 11 or the like, the front panel and the top of the barrier ribs are bonded together without the application of an adhesive to the top of the barrier ribs, resulting in the simplification of the manufacturing process.

According to the method of the present embodiment, the front panel and the top of the barrier ribs are bonded together by the material of the barrier ribs, not by an adhesive. This produces an advantage. In case the image display area of PDP includes an adhesive, the adhesive may release an impurity into the discharge gas. However, there is no such possibility in the PDPs manufactured with the method of the present embodiment.

However, it is also possible that the joint layer 45 is previously formed on top of the barrier ribs 24 as in Embodiment 11, then after the surrounding unit 40 is formed, the laser beam is radiated onto the joint layer 45 to bond the front panel and the top of the barrier ribs as in the present embodiment. This method ensures the bonding though the above advantages are not obtained.

Note that when a material such as the black filler which improves the absorption of laser beam is mixed with the material of the joint layer 45, the bonding is performed more securely.

Variations of Present Embodiment

Typically, such a laser processing apparatus 200 as described in the present embodiment can perform a precise, two-dimensional laser processing onto the work by micro-orders of magnitude. The bonding may be performed more precisely by disposing an apparatus for observing the surface of the work as described below.

Figure 24:
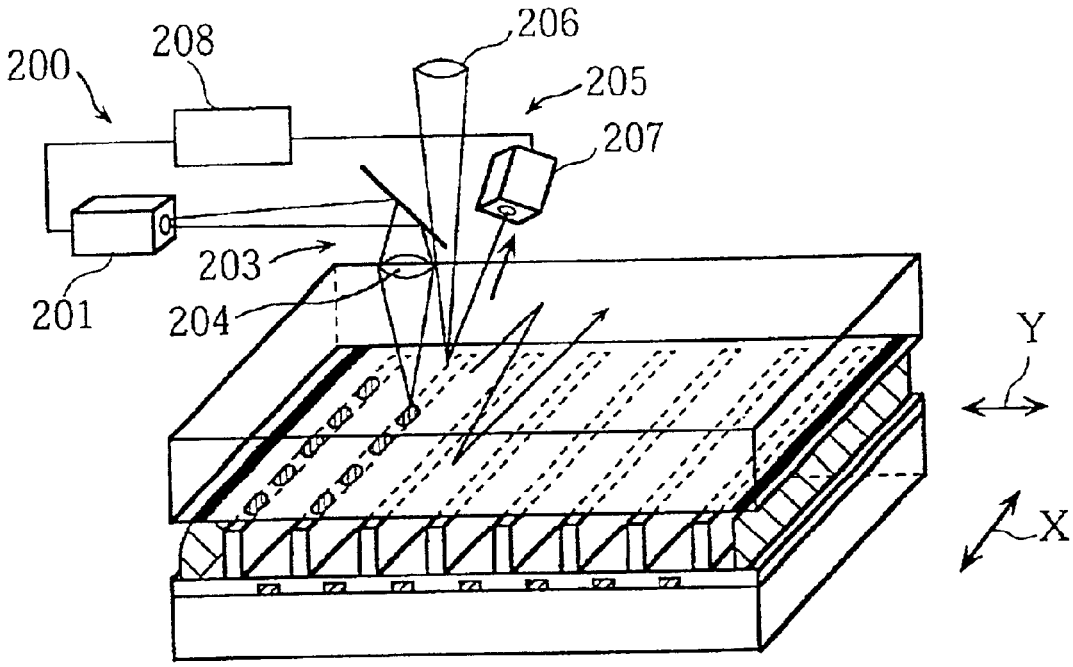
FIG. 24 shows an example of the laser processing apparatus used in Embodiment 13.

FIG. 24 shows the laser processing apparatus 200 being provided with an observation head 205, as well as the laser head 203. The observation head 205 includes: a probe beam emitter 206 for radiating a probe beam onto the surface of the work; and a detector 207 for detecting the probe beam reflected from the surface of the work. The observation head 205 scans a work (surrounding unit 40) vertically and horizontally (in the directions X and Y shown in FIG. 22B) as the laser head 203 does.

A controller 208 monitors the shape of the barrier ribs 24 by allowing the observation head 205 to scan and receiving signals from the detector 206 (i.e., the controller 208 stores x-y coordinate values on the table 202 as the information indicating positions of the barrier ribs).

The controller 208 also fine-tunes the laser head 203 in the Y direction using the stored positional information on the barrier ribs so that the laser beam is radiated onto the exact center of each barrier rib when the laser head 203 scans the barrier ribs in the X direction.

Such an arrangement ensures that the laser beam is radiated onto the center of each barrier rib even if the barrier ribs 24 are curved (snaky) or are partially lacking, resulting in a high-precision bonding of the front panel and the barrier ribs.

Alternatively, the intensity of the laser beam may be adjusted by monitoring the width of the barrier ribs or the reflectivity of the laser beam using the laser processing apparatus 200 shown in FIG. 24.

When the top of the barrier ribs is softened by radiating a laser beam there, it is considered that the wider the barrier rib is or the higher the reflectivity is, the less the temperature rises by the laser radiation and the smaller the bonded area is. On the contrary, when the joint layer is formed on top of the barrier ribs, the bonded area may increase when the barrier rib is wider since the amount of joint material also increases. Accordingly, when the radiation intensity of the laser beam is fixed, the bonding state (the area of the barrier ribs that melts) tends to vary for each position on the top of the barrier ribs as the width of the rib or the reflectivity varies.

The above problem can be solved by controlling the radiation intensity or the radiation angle of the laser beam in accordance with the monitored width and the monitored reflectivity at each position on the top of the barrier ribs.

In the present embodiment, the bonding process in which the front panel 10 and the top of the barrier ribs 24 are bonded by radiation of the laser beam is performed after the sealing process in which the pressure inside the surrounding unit 40 kept lower than the pressure outside. However, the bonding process may be performed after a conventional sealing process. Although, in this case, the bonding is thought to be inferior than the present embodiment since they are bonded while there is more gap between the front panel 10 and the top of the barrier ribs.

In the present embodiment, the bonding process in which the front panel 10 and the top of the barrier ribs 24 are bonded by radiation of the laser beam is performed after the sealing process. However, the bonding process may be performed prior to or in parallel to the sealing process.

When the bonding process is performed in prior to the sealing process, it is preferable that to the panels in entirety, the rim of the surrounding unit 40 is sealed by an outer sealing layer as in Embodiment 2, then the panels are bonded while gas is exhausted from the inner space of the surrounding unit 40 to reduce the pressure inside.

In the present embodiment, the top of the barrier ribs or the adhesive is softened (melted) by radiating a laser beam thereon. However, the top of the barrier ribs or the adhesive may also be softened by radiating an energy such as ultrasonic waves onto the top of the barrier ribs or intensively heating the front panel 10 by a heater.

Alternatively, the surrounding unit 40 may be formed by putting the front and back panels together while the front panel has been heated and is around the softening point of the barrier ribs 24 so that the top of the barrier ribs or the adhesive in contact with the front panel 10 is softened to bond the front panel and the barrier ribs.

Embodiment 14

In the present embodiment, an exhaust pipe sealing apparatus which can chip off an exhaust pipe (e.g., the pipe 26 described in Embodiment 1) without difficulty will be described.

Figure 25:
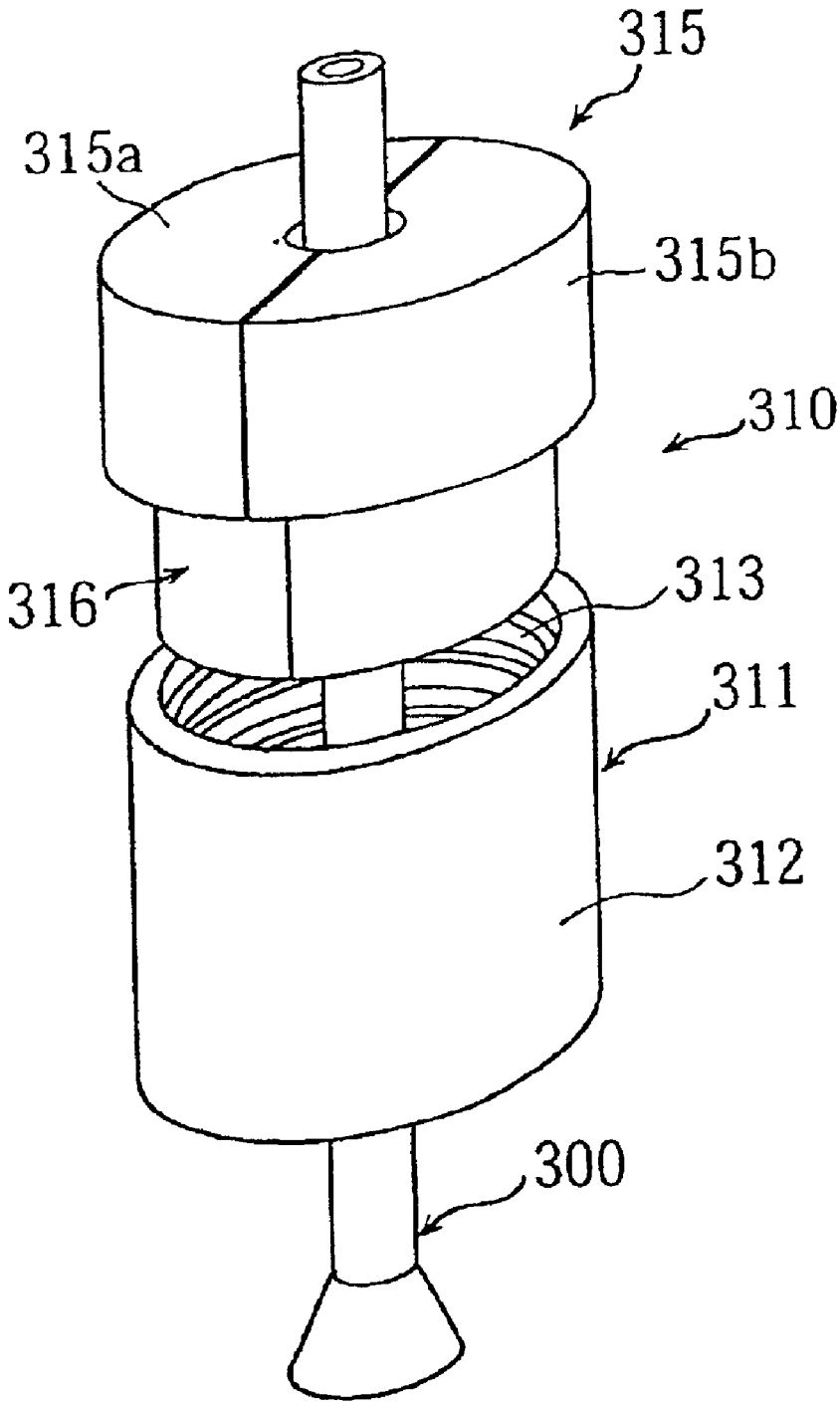
FIG. 25 is a perspective view showing an exhaust pipe sealing apparatus used in Embodiment 14.
Figure 26:
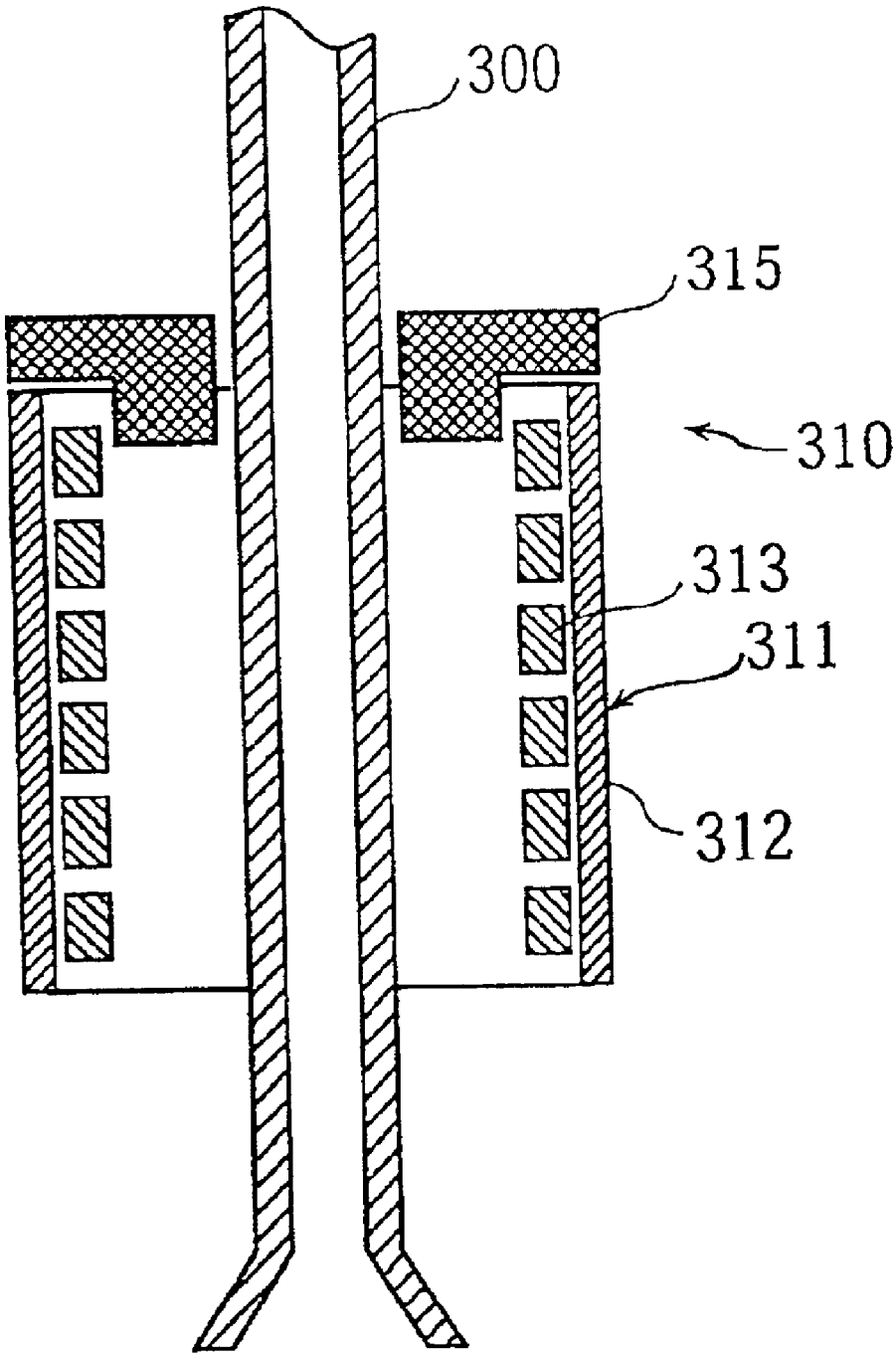
FIG. 26 is a sectional view of the exhaust pipe sealing apparatus shown in FIG. 25.

FIG. 25 is a perspective view showing an exhaust pipe sealing apparatus 310 attached to an exhaust pipe 300. FIG. 26 is a sectional view of the exhaust pipe sealing apparatus 310 attached to the exhaust pipe 300.

Although the surrounding unit is not illustrated in FIGS. 25 and 26, the base of the exhaust pipe 300, which is the lower part of it in the drawings, is connected to the air vent of the back panel (see FIG. 5).

The exhaust pipe sealing apparatus 310 is composed of: a heating unit 311 for heating the exhaust pipe 300; and a restriction member 315 for restricting the position of the heating unit 311 in relation to its attachment to the exhaust pipe 300.

The heating unit 311 is composed of: a cylindrical support member 312 having a diameter larger than the outer diameter of the exhaust pipe 300; and an electric heater 313 which is a coil wound inside the support member 312 in entirety.

The restriction member 315 is a cylindrical member at the center of which a hole for inserting the exhaust pipe 300 is formed around the center axis. An end of the restriction member 315 (the lower end in the drawing) is formed as a fit-in member 316 having a smaller diameter than the restriction member 315 so that the fit-in member 316 is fitted into an end of the heating unit 311 (the upper end in the drawing).

The restriction member 315 is formed so as to be divided into two parts (which are referred to as restriction member parts 315*a* and 315*b*) by a plane passing the center axis.

A desirable material for the restriction member 315 is a ceramic which has a high insulation and a softening point higher than the exhaust pipe 300.

It is desirable that the hole of the restriction member 315 has a diameter only slightly larger than the outer diameter of the exhaust pipe 300. This is because if the diameter of the member 315 is much larger than the outer diameter of the pipe 300, the member 315 rattles as hard as cannot perform the positional restriction.

Also, it is desirable that the outer diameter of the fit-in member 316 is properly smaller than the inner diameter of the heating unit 311. This is because: when the former is much larger than the latter, the heating unit 311 contacts the electric heater 313; and when the former is much smaller than the latter, the electric heater 313 rattles as hard as cannot perform the positional restriction.

The above-constructed exhaust pipe sealing apparatus 310 seals the exhaust pipe 300 as follows.

First, the heating unit 311 is placed at a position where the exhaust pipe 300 is to be chipped off. Then, the fit-in member 316 of the restriction member 315 is fitted in the heating unit 311. Lastly, the electric current is passed through the electric heater 313 to heat and chip off the exhaust pipe 300.

Effects of Present Embodiment

When only the electric heater 313 is used to chip off the exhaust pipe 300 without using the restriction member 315, it often happens that the electric heater 313 melts the exhaust pipe 300 and the melted exhaust pipe 300 sticks to the heater 313, resulting in breakage of the pipe 300. On the contrary, when the exhaust pipe 300 is chipped off as described above using the restriction member 315, the chip-off is carried out without allowing the electric heater 313 to contact the exhaust pipe 300.

The restriction member 315 is formed so as to be divided into two parts by a plane passing the center axis. This facilitates the attachment of the member 315 to the place between the exhaust pipe 300 and the electric heater 313 after the heating unit 311 is fitted to the exhaust pipe 300.

Variations of Present Embodiment

In the present embodiment, the restriction member 315 is formed so as to be divided into the restriction member parts 315*a* and 315*b*. However, the restriction member 315 may not necessarily be formed so as to be divided into parts.

Figure 27:
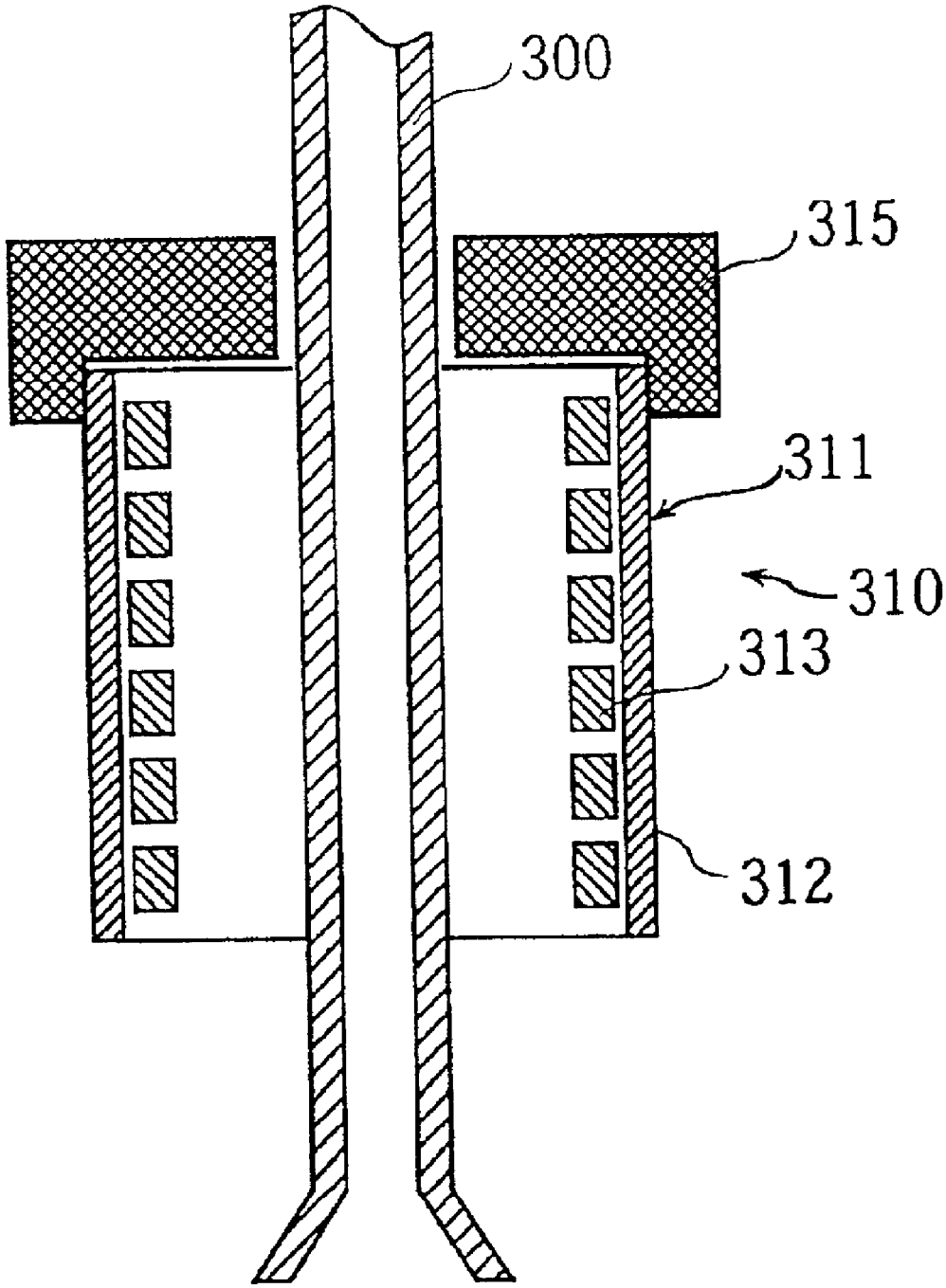
FIG. 27 is a variation of the exhaust pipe sealing apparatus of Embodiment 14.

The exhaust pipe sealing apparatus 310 shown in FIG. 26 is constructed so that an end of the heating unit 311 can be fitted to outside of the fit-in member 316 of the restriction member 315. However, the exhaust pipe sealing apparatus 310 may be constructed so that an end of the heating unit 311 is fitted to inside of the fit-in member 316 of the restriction member 315, as shown in FIG. 27. This variation also produces the same effects as the present embodiment.

Figure 28:
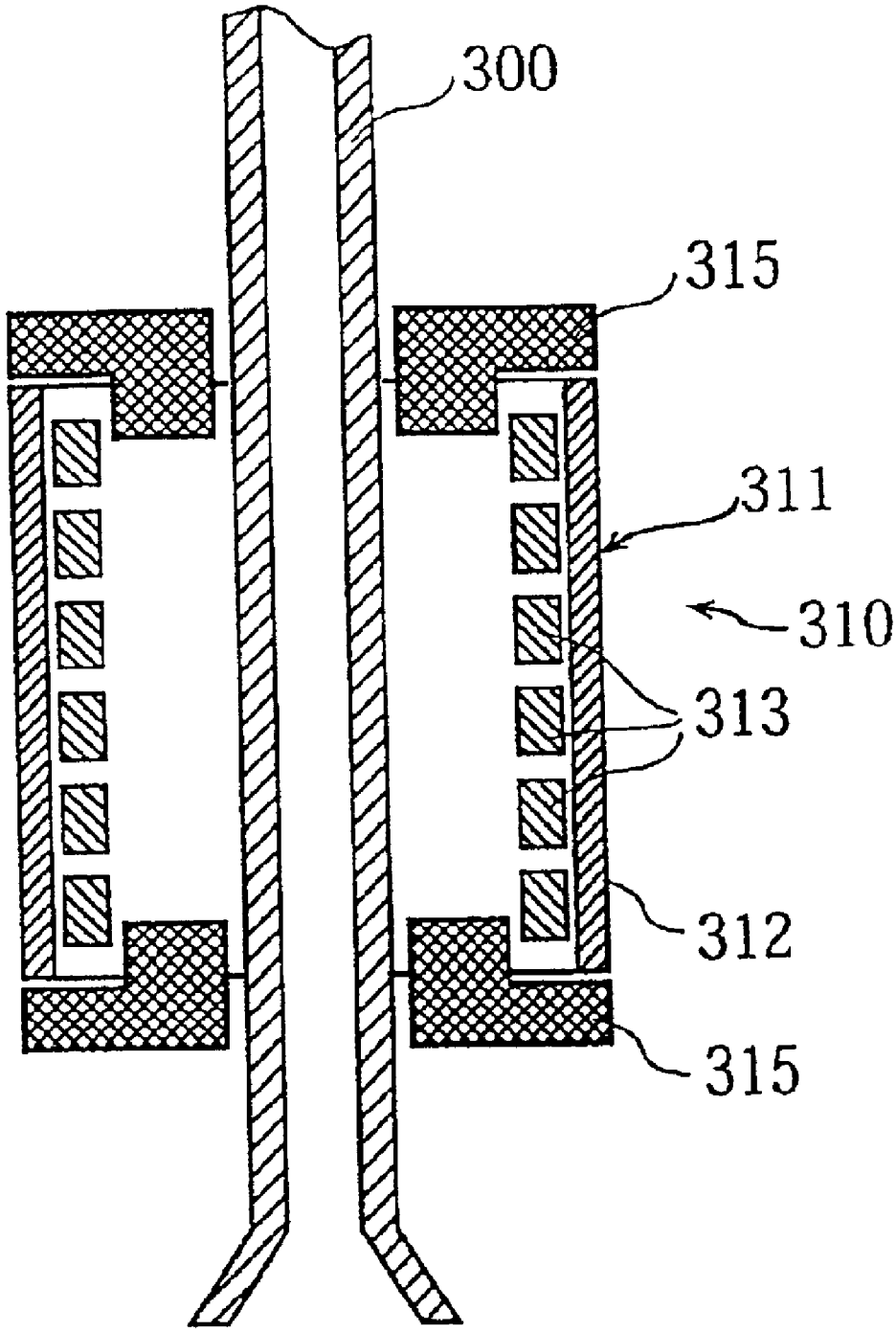
FIG. 28 is a variation of the exhaust pipe sealing apparatus of Embodiment 14.

The exhaust pipe sealing apparatus 310 shown in FIG. 26 is constructed so that an end of the heating unit 311 is fitted to the restriction member 315. However, the exhaust pipe sealing apparatus 310 may be constructed so that both ends of the heating unit 311 are fitted to the restriction member 315, as shown in FIG. 28. That is, the restriction member 315 restricts the position of the heating unit 311 at two points. This enables the restriction member 315 to restrict the positions of the electric heater 313 and the exhaust pipe 300 an more surely and prevent them from contacting each other.

The exhaust pipe sealing apparatus 310 shown in FIG. 26 is constructed so that the restriction member 315 and the heating unit 311 are formed as separate units. However, the restriction member 315 and the heating unit 311 may be formed as one unit as shown in FIG. 29 of an exhaust pipe sealing apparatus 320.

Figure 29:
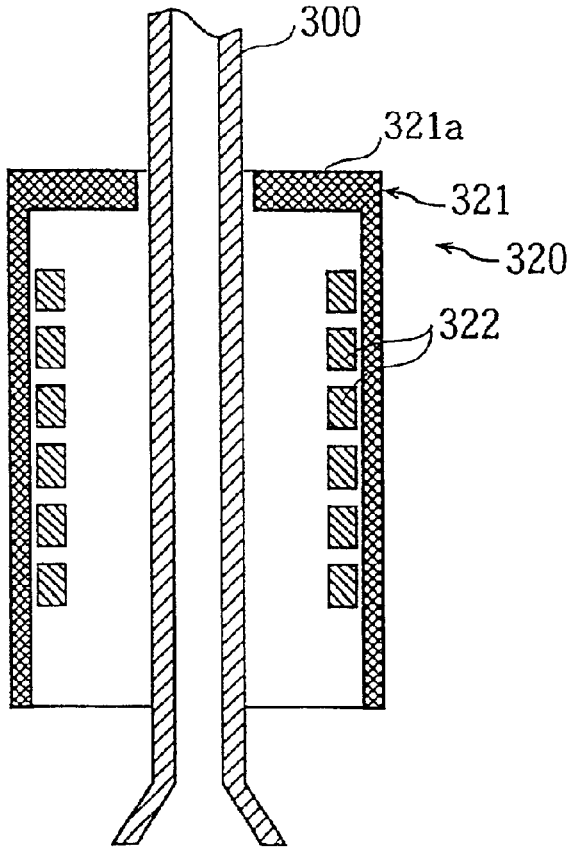
FIG. 29 is a variation of the exhaust pipe sealing apparatus of Embodiment 14.

The exhaust pipe sealing apparatus 320 shown in FIG. 29 is formed as one unit so that an electric heater 322 is wound inside a cylindrical restriction unit 321 on an end of which a lid 321*a* is formed. At the center of the lid 321*a*, a hole for inserting the exhaust pipe 300 is formed.

Figure 30:
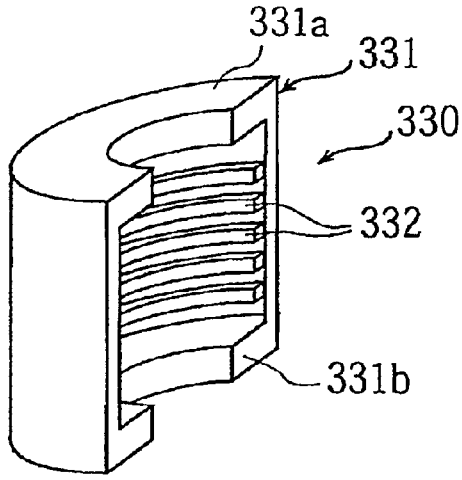
FIG. 30 is a variation of the exhaust pipe sealing apparatus of Embodiment 14.

FIG. 30 shows an exhaust pipe sealing apparatus 330 which is also formed as one unit so that an electric heater 332 is wound inside a cylindrical restriction unit 331 on both ends of which lids 331*a* and 331*b* are formed.

The exhaust pipe sealing apparatus 330 can be divided into two parts by a plane passing the center axis. FIG. 30 only shows one of the divided parts.

The exhaust pipe 300 can be chipped off by the exhaust pipe sealing apparatus 320 or 330, as the exhaust pipe sealing apparatus 310, by fitting the apparatus 320 or 330 to the exhaust pipe 300 then passing the electric current through the electric heater.

Variations of Embodiments 1 to 14

In the PDPs of the above embodiments, the barrier ribs 24 are formed on the back panel 20. However, the barrier ribs may be formed on the front panel.

In the above embodiments, the present invention is applied to AC-type PDPs. However, the present invention can generally be applied to the production of gas discharge panels as far as they are produced by bonding a panel to another panel on which barrier ribs are formed.

INDUSTRIAL APPLICABILITY

The gas discharge panels, especially PDPs, manufactured with the method or apparatus of the present invention can be used as displays of computers or TVs and are especially suitable for large-screen displays.

What is claimed is:

1. A gas discharge panel production method comprising:

a surrounding unit forming step for forming a surrounding unit by putting a first panel and a second panel together, wherein barrier ribs for partitioning light-emitting cells are formed on a main surface of the first panel, and the first panel and the second panel are put together to face each other with the barrier ribs in between; and a sealing step for sealing the surrounding unit with a sealing material inserted between the first panel and the second panel at the rim, wherein the sealing step includes:

a pressure adjustment sub-step for adjusting pressure so that pressure inside the surrounding unit is lower than pressure outside the surrounding unit.

2. The gas discharge panel production method of claim 1, wherein the pressure adjustment sub-step starts before the sealing material hardens.

3. The gas discharge panel production method of claim 2, wherein the sealing material softens when an energy is given from outside, and in the sealing step, the sealing material is first softened then hardened to seal the surrounding unit.

4. The gas discharge panel production method of claim 3, wherein in the surrounding unit forming step, a connection path which connects inside of the surrounding unit to outside of the surrounding unit is formed in the surrounding unit, and in the pressure adjustment sub-step, gas is exhausted from inside of the surrounding unit to outside of the surrounding unit via the connection path.

5. The gas discharge panel production method of claim 3, wherein in the sealing step, the surrounding unit is sealed while the first panel and the second panel is pressurized by fastening tools pinching the first panel and the second panel at the rim.

6. The gas discharge panel production method of claim 3 further comprising:

an adhesive application step for applying an adhesive to top of the barrier ribs on the first panel, the applied adhesive being to bond the top of the barrier ribs to the second panel, and the adhesive application step being performed before the surrounding unit forming step, and in the sealing step, the top of the barrier ribs and the second panel are bonded together by the applied adhesive as the surrounding unit is sealed by the sealing material.

7. A gas discharge panel produced with a production method defined in claim 3.

8. The gas discharge panel production method of claim 2, wherein in the surrounding unit forming step, a connection path which connects inside of the surrounding unit to outside of the surrounding unit is formed in the surrounding unit, and in the pressure adjustment sub-step, gas is exhausted form the inside of the surrounding unit to outside of the surrounding unit via the connection path.

9. The gas discharge panel production method of claim 8, wherein the surrounding unit is provided with an air vent which connects inside of the surrounding unit to outside of the surrounding unit, and a pipe is connected to the air vent with a crystallized glass in between, and in the pressure adjustment sub-step, gas is exhausted from inside of the surrounding unit to outside of the surrounding unit via the pipe.

10. The gas discharge panel production method of claim 2, wherein in the sealing step, the surrounding unit is sealed while the first panel and the second panel is pressurized by fastening tools pinching the first panel and the second panel at the rim.

11. A gas discharge panel produced with a production method defined in claim 2.

12. The gas discharge panel production method of claim 1, wherein the sealing step includes:

an airtightly seal sub-step for interrupting gas flow between inside and outside of the surrounding unit, and in the pressure adjustment sub-step, pressure inside the surrounding unit after the airtightly seal sub-step is adjusted to be lower than before the airtightly seal sub-step.

13. The gas discharge panel production method of claim 12, wherein in the sealing step, the surrounding unit is sealed while the first panel and the second panel is pressurized by fastening tools pinching the first panel and the second panel at the rim.

14. The gas discharge panel production method of claim 12, further comprising:

an adhesive application step for applying an adhesive to top of the barrier ribs on the first panel, the applied adhesive being to bond the top of the barrier ribs to the second panel, and the adhesive application step being performed before the surrounding unit forming step, and in the sealing step, the top of the barrier ribs and the second panel are bonded together by the applied adhesive as the surrounding unit is sealed by the sealing material.

15. A gas discharge panel produced with a production method defined in claim 12.

16. The gas discharge panel production method of claim 1, wherein in the sealing step, the surrounding unit is sealed while an anti-displacement means for preventing a relative displacement of the first panel and the second panel is disposed on the surrounding unit.

17. The gas discharge panel production method of claim 1, wherein an anti-sealing-material-inflow member is disposed at the rim of at least one of the first panel and the second panel to be used in the surrounding unit forming step so as to prevent the sealing material from flowing into an inner area of the surrounding unit.

18. The gas discharge panel production method of claim 17, wherein the sealing material is disposed at outside the anti sealing-material-inflow member during the surrounding unit forming step.

19. The gas discharge panel production method of claim 1 further comprising:

an adhesive application step for applying an adhesive to top of the barrier ribs on the first panel, the applied adhesive being to bond the top of the barrier ribs to the second panel, and the adhesive application step being performed before the surrounding unit forming step, and in the sealing step, the top of the barrier ribs and the second panel are bonded together by the applied adhesive as the surrounding unit is sealed by the sealing material.

20. A gas discharge panel production method comprising:

a surrounding unit forming step for forming a surrounding unit by putting a first panel and a second panel together, wherein barrier ribs for partitioning light-emitting cells are formed on a main surface of the first panel, and the first panel and the second panel are put together to face each other with the barrier ribs in between; and a sealing step for sealing the surrounding unit with a sealing material inserted between the first panel and the second panel at the rim, wherein in the sealing step, the surrounding unit is sealed while the first panel and the second panel are pinched by the fastening tools at an area in which the barrier ribs are formed, wherein an anti-deformation member is disposed at the rim of at least one of the first panel and the second panel to be used in the surrounding unit forming step so as to prevent the first panel and the second panel from deforming by pressure by the fastening tools.

21. The gas discharge panel production method of claim 20, wherein the anti-deformation member and the barrier ribs are made of the same material.

22. The gas discharge panel production method of claim 20, wherein the anti-deformation member is formed so as to prevent the sealing material from flowing into an inner area of the surrounding unit.

23. The gas discharge panel production method of claim 20, wherein the anti-deformation member and the barrier ribs have the same height.

24. A gas discharge panel production method comprising:

a surrounding unit forming step for forming a surrounding unit by putting a first panel and a second panel together, wherein barrier ribs for partitioning light-emitting cells are formed on a main surface of the first panel, and the first panel and the second panel are put together to face each other with the barrier ribs in between; and a sealing step for sealing the surrounding unit with a sealing material inserted between the first panel and the second panel at the rim, wherein in the sealing step, the surrounding unit is sealed while the first panel and the second panel are pinched by the fastening tools at an area in which the barrier ribs are formed, wherein in the sealing step, the first panel and the second panel are pinched by the fastening tools at an image display area.

25. The gas discharge panel production method of claim 24, wherein in the sealing step, the first panel and the second panel are pinched by clips.

* * * * *